US007686408B2

(12) United States Patent
Tamura

(10) Patent No.: US 7,686,408 B2
(45) Date of Patent: Mar. 30, 2010

(54) ELECTRICALLY-CHARGEABLE ELEMENT CONTROL DEVICE, LIQUID EJECTION DEVICE, AND METHOD FOR CONTROLLING ELECTRICALLY-CHARGEABLE ELEMENT

(75) Inventor: Noboru Tamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 517 days.

(21) Appl. No.: 11/512,912

(22) Filed: Aug. 30, 2006

(65) Prior Publication Data

US 2007/0046703 A1 Mar. 1, 2007

(30) Foreign Application Priority Data

Aug. 31, 2005 (JP) ..... 2005-251344

(51) Int. Cl.
*B41J 29/38* (2006.01)
*B41J 2/45* (2006.01)

(52) U.S. Cl. ..... 347/9; 347/68

(58) Field of Classification Search ..... 347/9; 320/166

See application file for complete search history.

(56) References Cited

U.S. PATENT DOCUMENTS 4,498,089 A * 2/1985 Scardovi ..... 347/68
6,443,547 B1 * 9/2002 Takahashi et al. ..... 347/9
6,753,687 B2 * 6/2004 Nitta et al. ..... 324/548

FOREIGN PATENT DOCUMENTS

JP 10011015 A * 1/1998
JP 11-320872 11/1999

OTHER PUBLICATIONS

Machine translation of patent document JP 11-320872 to Tamura; translation performed Sep. 23, 2008.*
Patent Abstracts of Japan of 11-320872 dated Nov. 24, 1999.

* cited by examiner

*Primary Examiner*—Matthew Luu
*Assistant Examiner*—Shelby Fidler
(74) *Attorney, Agent, or Firm*—Ladas and Parry LLP

(57) ABSTRACT

An electrically-chargeable element control device includes a plurality of coils, a switch circuit, and a controller. One end of each of a plurality of the coils is connected to a power supply. The switch circuit is connected to an other end of each of a plurality of the coils and is connected to one electrode provided on each of a plurality of electrically-chargeable elements. The controller connects a selected coil to an electrically-chargeable element to be charged and discharged by controlling the switch circuit depending on the number of the electrically-chargeable elements to be charged and discharged, and charges and discharges with resonance the electrically-chargeable element to be charged and discharged.

9 Claims, 13 Drawing Sheets

| N | C | Ct | selected coil | L | L×C |
|---|---|---|---|---|---|
| 1 | C0 | 0000 0001 | L1 | L0 | C0×L0 |
| 2 | 2×C0 | 0000 0010 | L2 | L0/2 | C0×L0 |
| 3 | 3×C0 | 0000 0011 | L2,L1 | L0/3 | C0×L0 |
| 4 | 4×C0 | 0000 0100 | L3 | L0/4 | C0×L0 |
| 5 | 5×C0 | 0000 0101 | L3, L1 | L0/5 | C0×L0 |
| ⋮ | ⋮ | ⋮ | ⋮ | ⋮ | ⋮ |
| 236 | 236×C0 | 1110 1100 | L8,L7,L6, L4,L3 | L0/236 | C0×L0 |
| 237 | 237×C0 | 1110 1101 | L8,L7,L6, L4,L3, L1 | L0/237 | C0×L0 |
| 238 | 238×C0 | 1110 1110 | L8,L7,L6, L4,L3,L2 | L0/238 | C0×L0 |
| 239 | 239×C0 | 1110 1111 | L8,L7,L6, L4,L3,L2,L1 | L0/239 | C0×L0 |
| 240 | 240×C0 | 1111 0000 | L8,L7,L6,L5 | L0/240 | C0×L0 |

Fig.12

ELECTRICALLY-CHARGEABLE ELEMENT CONTROL DEVICE, LIQUID EJECTION DEVICE, AND METHOD FOR CONTROLLING ELECTRICALLY-CHARGEABLE ELEMENT

CROSS-REFERENCE TO RELATED APPLICATIONS

The present application claims priority from Japanese Patent Application No. 2005-251344 filed on Aug. 31, 2005 which is herein incorporated by reference.

BACKGROUND

1. Technical Field

The present invention relates to an electrically-chargeable element control device, a liquid ejection device having an electrically-chargeable element, and a method for controlling an electrically-chargeable element.

2. Related Art

A control device which is for controlling charge and discharge of an electrically-chargeable element such as a piezo element or a capacitor is used in an inkjet printer (that is, a type of a liquid ejection device; hereinafter referred merely to as a printer), for example. Some of the control devices control charge and discharge by utilizing resonance between a coil and an electrically-chargeable element (see JP-A-11-320872, for example). Utilizing resonance enables driving without consuming electric power and this is useful for saving energy or for solving a problem of heat evolution which occurs when a linear amp or a resistive element is used for driving. In case of utilizing resonance between a coil and an electrically-chargeable element as mentioned above, a completion rate of charge with respect to time is determined depending on a resonance cycle. Accordingly, in the case of a printer, an amount of ink ejected is changed as the resonance cycle varies. Here, the resonance cycle varies depending on capacitance of an electrically-chargeable element. Therefore, if the number of electrically-chargeable elements to be charged and discharged, that is, the number of nozzles to eject ink, varies, an amount of ink ejected from one nozzle also varies. Accordingly, there is a need for a system to keep a resonance cycle uniform regardless of the number of nozzles to eject ink. In the above-mentioned control device, a capacitor for adjusting capacitance (a dummy capacitor) is provided in order for a resonance cycle to remain uniform.

In the above-mentioned control device, there is an advantage that a resonance cycle can remain uniform regardless of the number of electrically-chargeable elements to be charged and discharged. However, a current which flows at the time of charge and discharge also remains uniform regardless of the number of electrically-chargeable elements to be charged and discharged. More specifically, an amount of the current becomes an amount necessary to charge and discharge all electrically-chargeable elements at any time of charge and discharge. Furthermore, since capacitance of commercially available capacitors is standardized, it is necessary to use a custom-made capacitor having specific capacitance or a plurality of capacitors having different capacitance in order to obtain desired capacitance.

SUMMARY

An advantage of some aspects of the invention is to prevent an unnecessary excessive current from flowing while a resonance cycle remains uniform regardless of the number of electrically-chargeable elements to be charged and discharged.

A primary aspect of the invention for achieving the preceding advantage is an electrically-chargeable element control device, including:

(a) a plurality of coils whose respective one ends are connected to a power supply;

(b) a switch circuit that is connected to an other end of each of a plurality of the coils, and that is connected to one electrode provided on each of a plurality of electrically-chargeable elements; and (c) a controller that causes a selected coil to connect to an electrically-chargeable element to be charged and discharged by controlling the switch circuit depending on the number of the electrically-chargeable elements to be charged and discharged, and that causes to charge and discharge with resonance the electrically-chargeable element to be charged and discharged.

Other features of the present invention are described in the specification and the drawings.

BRIEF DESCRIPTION OF THE DRAWINGS

FIG. 12 is a table explaining the number of piezo elements to be charged and discharged and selected coils.

DESCRIPTION OF EXEMPLARY EMBODIMENTS

Figure 1:
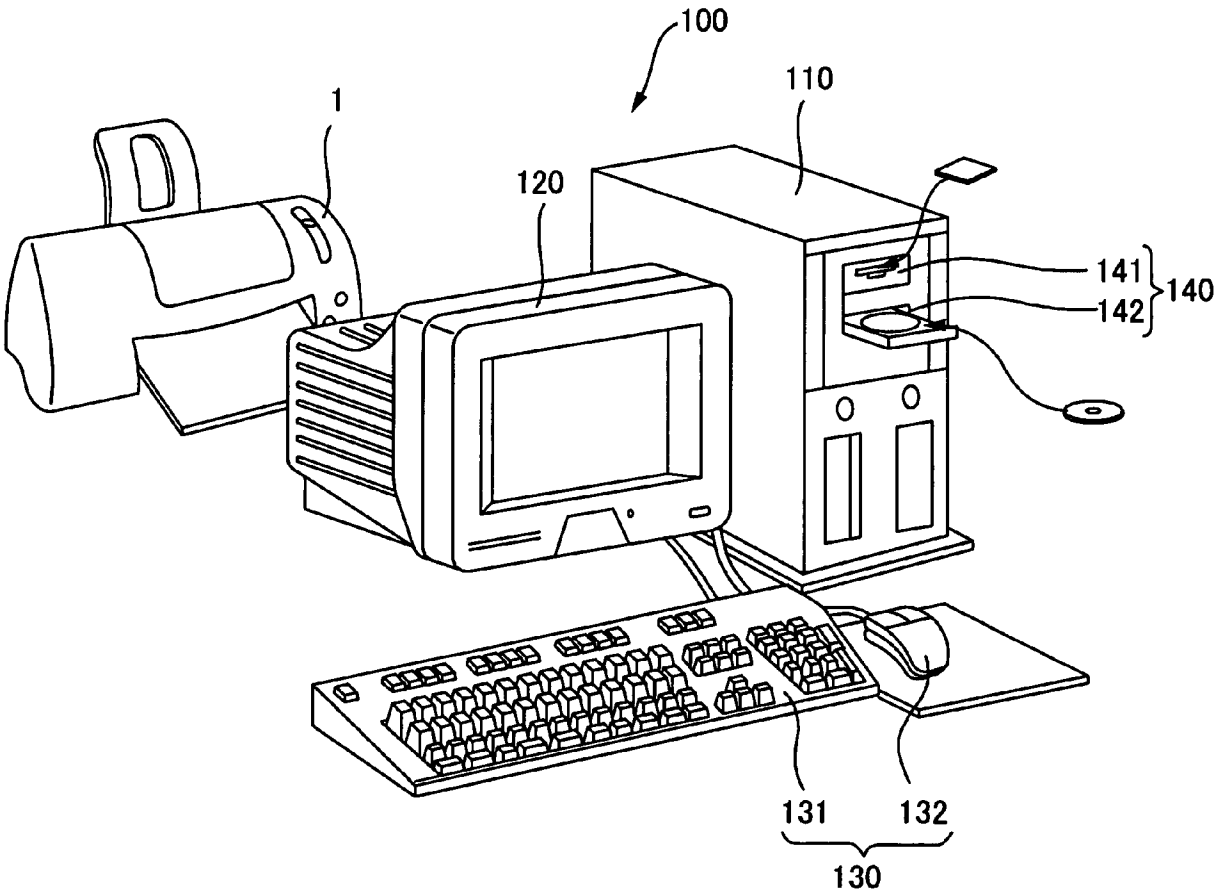
FIG. 1 is an explanatory diagram showing the configuration of a printing system.

At least the following matters will become clear through the description of the present specification and the accompanying drawings.

More specifically, an aspect of this invention achieves an electrically-chargeable element control device including: a plurality of coils whose respective one ends are connected to a power supply; a switch circuit that is connected to an other end of each of a plurality of the coils, and that is connected to one electrode provided on each of a plurality of electrically-chargeable elements; and a controller that causes a selected coil to connect to an electrically-chargeable element to be charged and discharged by controlling the switch circuit depending on the number of the electrically-chargeable elements to be charged and discharged, and that causes to charge and discharge with resonance the electrically-chargeable element to be charged and discharged.

This electrically-chargeable element control device enables to select a coil (that is, to determine inductance) depending on the number of electrically-chargeable elements to be charged and discharged. It also enables to determine a resonance cycle to be a desired value regardless of the number of the electrically-chargeable elements to be charged and discharged because the resonance cycle is determined by capacitance of the electrically-chargeable elements and inductance of the coils. An amount of a current which flows at the time of charge and discharge is determined by total capacitance of the electrically-chargeable element. Accordingly, this prevents a problem that an unnecessary excessive current flows.

In this electrically-chargeable element control device, it is preferable that a plurality of the coils include a reference coil having a largest inductance and an other coil whose inductance is determined to decrease by a ratio of $1/2^n$ (n is a natural number) with respect to the inductance of the reference coil, and that the controller determines a selection manner of the reference coil and the other coil depending on the number of the electrically-chargeable elements to be charged and discharged.

This electrically-chargeable element control device enables to obtain total inductance of a desired value even in a case of a small number of coils.

In this electrically-chargeable element control device, it is preferable that the controller causes a binary counter to count the number of the electrically-chargeable elements to be charged and discharged and controls the switch circuit depending on a counted value obtained.

This electrically-chargeable element control device enables to simplify control because the reference coil or the other coil is selected depending on the counted value of the binary counter.

In this electrically-chargeable element control device, it is preferable that the switch circuit includes a first switch group for connecting selectively a plurality of the coils and a second switch group for connecting selectively a plurality of the electrically-chargeable elements, and that the controller causes to obtain the number of the electrically-chargeable elements to be charged and discharged according to control information for the second switch group and controls the first switch group.

This electrically-chargeable element control device enables to simplify the configuration thereof because the number of the electrically-chargeable elements to be charged and discharged is obtained according to the control information for the second switch group and thereby no dedicated signal line is required.

In this electrically-chargeable element control device, it is preferable to include an other switch circuit for equalizing the electric potential between the one electrode and an other electrode that are provided on the electrically-chargeable element.

This electrically-chargeable element control device enables to equalize, at a desired timing, the electric potential between a pair of electrodes provided on the electrically-chargeable element. As a result thereof, the electric potential becomes easier to control.

In this electrically-chargeable element control device, it is preferable that the electrically-chargeable element is configured by a piezo element that is deformed by charging and discharging.

This electrically-chargeable element control device enables to obtain mechanical energy from electrical energy.

In this electrically-chargeable element control device, it is preferable to include an other electrically-chargeable element which is connected in parallel with a plurality of the electrically-chargeable elements and which is charged and discharged regardless of the presence or absence of the electrically-chargeable element to be charged and discharged.

This electrically-chargeable element control device enables the other electrically-chargeable element to stabilize operation.

In this electrically-chargeable element control device, it is preferable that the other electrically-chargeable element is configured by a capacitor.

This electrically-chargeable element control device enables to determine capacitance precisely.

Also, an electrically-chargeable element control device having the configuration described below can be achieved.

More specifically, an aspect of this invention achieves an electrically-chargeable element control device including: a plurality of coils whose respective one ends are connected to a power supply, a plurality of the coils including: a reference coil having a largest inductance and an other coil whose inductance is determined to decrease by a ratio of $1/2^n$ (n is a natural number) with respect to the inductance of the reference coil; a switch circuit which is connected to an other end of each of a plurality of the coils and which is connected to one electrode provided on each of a plurality of electrically-chargeable elements configured by a piezo element that is deformed by charging and discharging, the switch circuit including: a first switch group for connecting selectively a plurality of the coils and a second switch group for connecting selectively a plurality of the electrically-chargeable elements; an other switch circuit for equalizing the electric potential between the one electrode and an other electrode that are provided on the electrically-chargeable element; a controller which: causes a binary counter to count the number of electrically-chargeable elements to be charged and discharged, according to control information for the second switch group, controls the first switch group depending on a counted value obtained, determines a selection manner of the reference coil and the other coil, causes a selected coil to connect to the electrically-chargeable element to be charged and discharged, and causes to charge and discharge with resonance the electrically-chargeable element to be charged and discharged; and an other electrically-chargeable element which: is configured by a capacitor, the other electrically-chargeable element being connected in parallel with a plurality of the electrically-chargeable elements, and being charged and discharged regardless of the presence or absence of the electrically-chargeable element to be charged and discharged.

The advantage of some aspects of the present invention is achieved most effectively because this electrically-chargeable element control device enables all effects mentioned above to be achieved.

In addition, a liquid ejection device having the configuration described below can be achieved.

More specifically, an aspect of this invention achieves a liquid ejection device including: a plurality of coils whose respective one ends are connected to a power supply and whose respective other ends are connected to a switch circuit; a plurality of electrically-chargeable elements whose respective one ends are connected to the switch circuit and which are deformed depending on stored electric charge; a plurality of pressure chambers which are respectively provided corresponding to each of a plurality of the electrically-chargeable elements and which generates fluctuation in the pressure of stored liquid by deformation of the electrically-chargeable element; a plurality of nozzles which are respectively in communication with each of a plurality of the pressure chambers; and a controller which causes a selected coil to connect to an electrically-chargeable element that corresponds to the nozzle that is to eject liquid by controlling the switch circuit depending on the number of the nozzles that is to eject liquid, and which causes to eject the liquid from the nozzle that is to eject liquid by causing to charge and discharge with resonance the electrically-chargeable element corresponding to the nozzle.

Furthermore, a method for controlling an electrically-chargeable element described below can be achieved.

More specifically, an aspect of this invention achieves a method for controlling an electrically-chargeable element including: obtaining the number of electrically-chargeable elements to be charged and discharged from among a plurality of electrically-chargeable elements; selecting a coil to be connected, from among a plurality of coils whose respective one ends are connected to a power supply, depending on the number of the electrically-chargeable elements to be charged and discharged; and connecting the selected coil to the electrically-chargeable element to be charged and discharged, and charging and discharging with resonance the electrically-chargeable element to be charged and discharged.

The First Embodiment

Regarding Electrically-Chargeable Element and Control Device Thereof

An electrically-chargeable element is an element which can store electric charge, such as a piezo element, a capacitor, and the like. An electrically-chargeable element control device controls charge and discharge of the electrically-chargeable element. The electrically-chargeable element and the electrically-chargeable element control device are provided on a printer, for example. As mentioned later in detail, in this printer, a piezo element is used as a driving power source for ejecting ink. An amount of deformation of the piezo element is determined depending on a quantity of stored electric charge. Accordingly, the printer ejects ink by controlling charge and discharge of the piezo element.

The printer prints an image on a medium such as paper, etc. by ejecting liquid ink. Accordingly, the printer is a type of a printing apparatus and is a type of a liquid ejection device. As liquid ejection devices there are, in addition to a printer (a printing apparatus), a variety of equipment: color filter manufacturing equipment, display manufacturing equipment, semiconductor manufacturing equipment, DNA chip manufacturing equipment, and the like. The specification describes an example of a printer, as a printing apparatus, and a printing system having the printer. The printing system includes at least a printing apparatus and a printing control apparatus which controls operation of the printing apparatus. The printing system serves as one embodiment of a liquid ejection system having a liquid ejection device and an ejection control device.

===Configuration of Printing System 100===

FIG. 1 is an explanatory diagram showing the configuration of a printing system 100. The illustrated printing system 100 has a printer 1 as the printing apparatus and a computer 110 as a printing control apparatus. Specifically, the printing system 100 has the printer 1, the computer 110, a display device 120, an input device 130, and a record/play device 140. The printer 1 prints an image on a medium, such as paper, cloth, film and the like by ejecting ink, which is a type of liquid. The medium serves as a target object to which the liquid is ejected. This section below describes an example of a paper S, which is a typical medium (see FIG. 3A). The computer 110 is communicably connected to the printer 1. In order to make the printer 1 print an image, the computer 110 outputs print data corresponding to that image to the printer 1. This computer 110 has computer programs, such as an application program and a printer driver, installed thereon. This display device 120 displays a user interface of the computer program, for example. The input device 130 is, for example, a keyboard 131 and a mouse 132. The record/play device 140 is, for example, a flexible disk drive device 141 and a CD-ROM drive device 142.

===Computer 110===

Regarding Configuration of Computer 110

Figure 2:
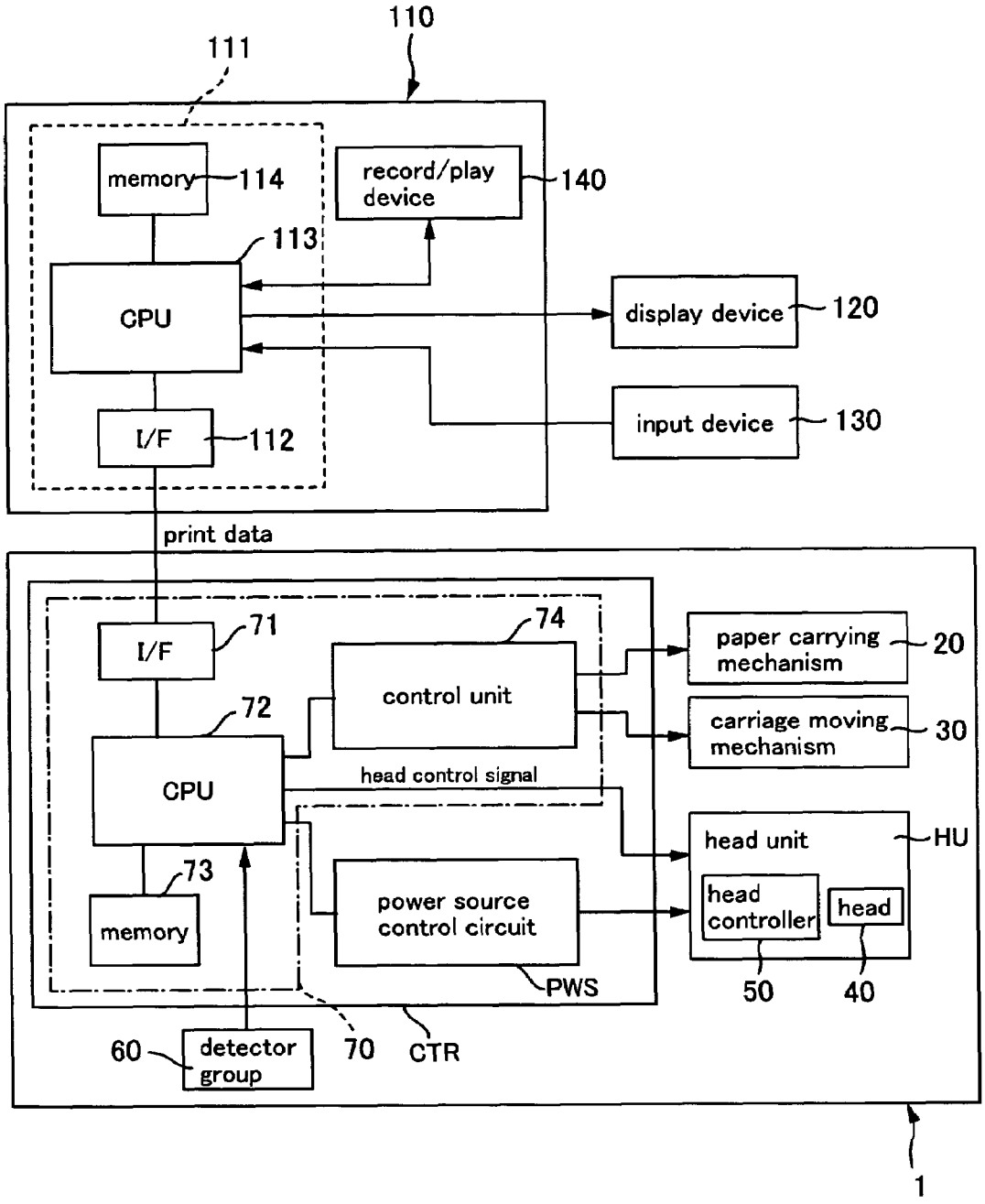
FIG. 2 is a block diagram showing the configuration of a computer and a printer.

FIG. 2 is a block diagram showing the configuration of the computer 110 and the printer 1. First, the configuration of the computer 110 is described briefly. This computer 110 has the record/play device 140 mentioned above and a host-side controller 111. The record/play device 140 is connected communicably to the host-side controller 111 and is attached to an enclosure of the computer 110, for example. The host-side controller 111 performs various controls on the computer 110, and the display device 120 and the input device 130 mentioned above are connected communicably to the host-side controller 111. This host-side controller 111 has an interface section 112, a CPU 113, and a memory 114. The interface section 112 is provided between the computer 110 and the printer 1 and exchanges data therebetween. The CPU 113 is a processing unit for carrying out overall control of the computer 110. The memory 114 is for reserving a work area and a storage area for storing the computer programs for the CPU 113, and includes storage devices such as a RAM, an EEPROM, a ROM, or a magnetic disk device. As mentioned above, the computer program stored in this memory 114 is an application program, a printer driver or the like. The CPU 113 performs various controls according to the computer program stored in the memory 114.

Figure 6:
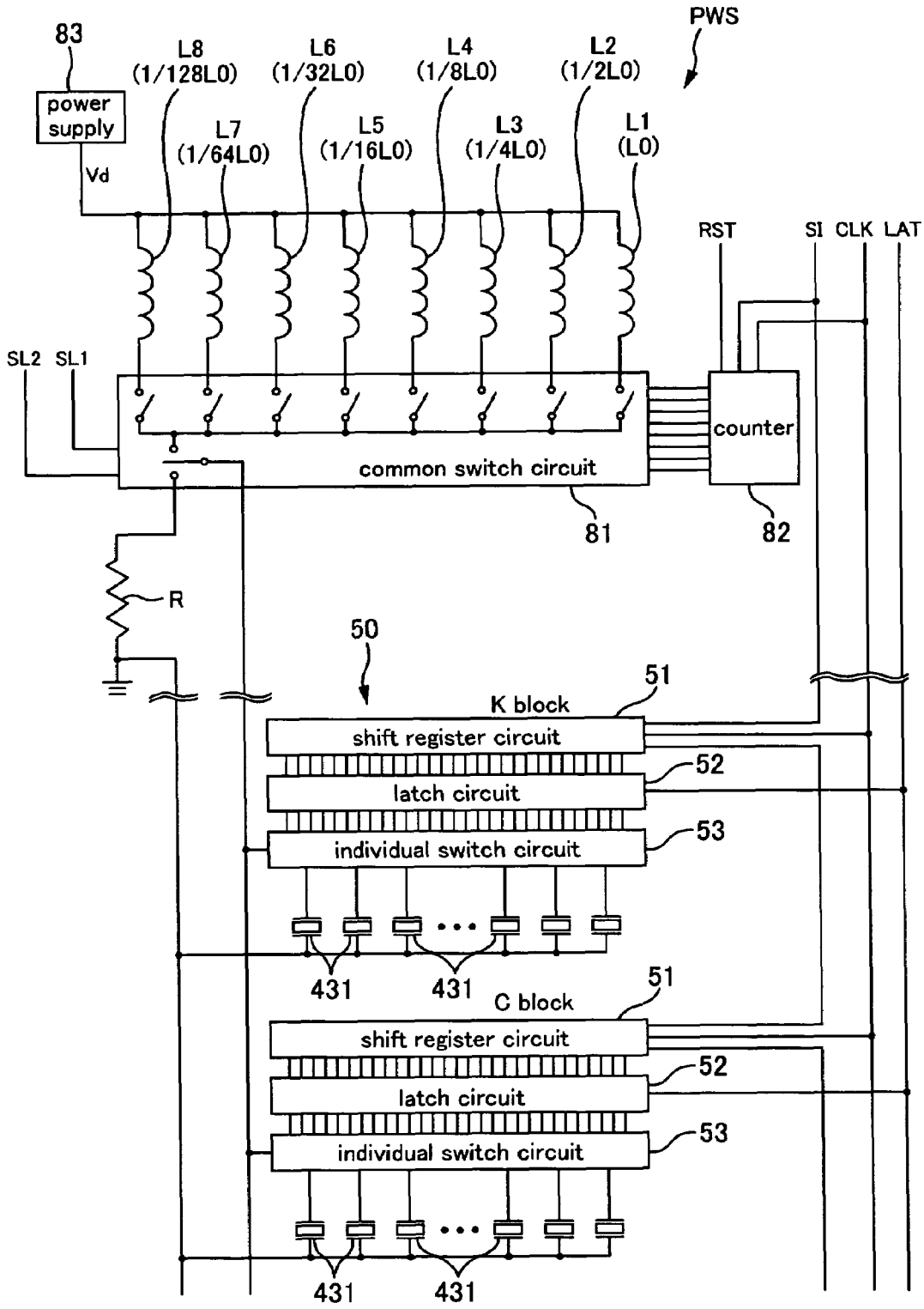
FIG. 6 is a schematic block diagram showing a power source control circuit and a head controller.

The print data is data in a form that can be interpreted by the printer 1, and includes various command data and dot formation data SI (see FIG. 6). The command data is data for instructing the printer 1 to execute a specific operation. Among the command data are, for example, command data for instructing to supply paper, command data for indicating a carry amount, and command data for instructing to discharge paper. The dot formation data SI is data relating to dots which an image to be printed consists of. Here, formation/non-formation of the dot is determined for each of virtual square regions defined on the paper S (also referred to as a "unit region"). The dot formation data SI in the present embodiment consists of 1-bit data for each one nozzle. More specifically, the dot formation data SI consists of data "1" corresponding to formation of a dot (ejection of ink) and data "0" corresponding to non-formation of a dot (non-ejection of ink).

===Printer 1===

Regarding Configuration of Printer 1

Figure 3A:
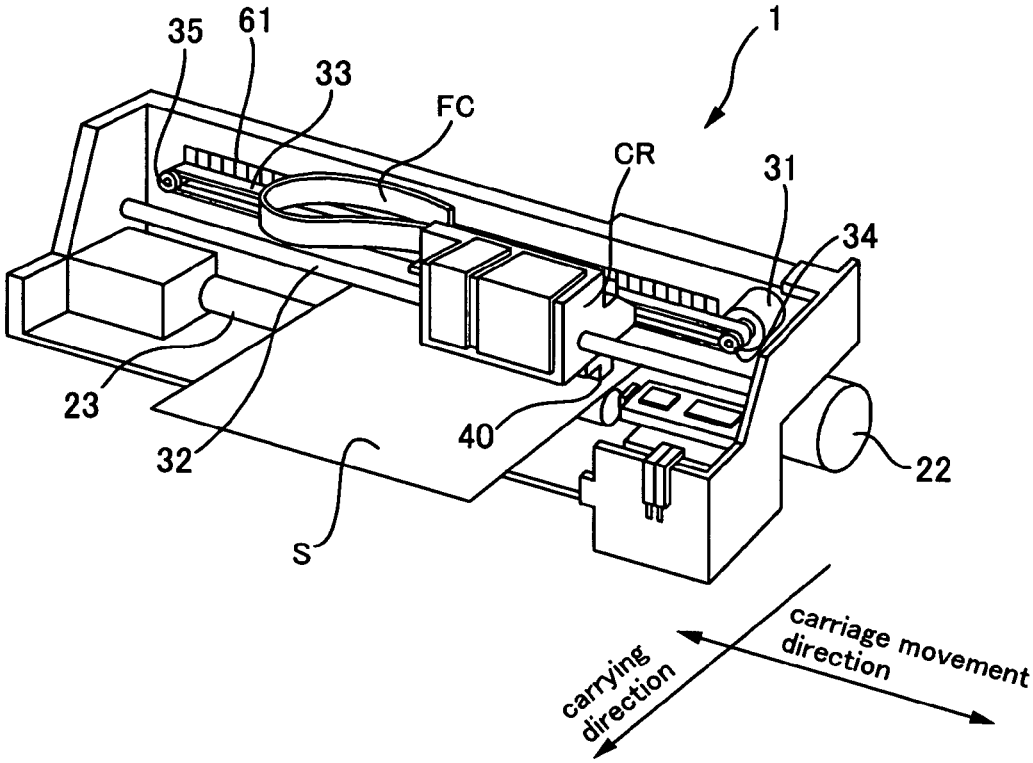
FIG. 3A is a schematic diagram showing the structure of a printer.
Figure 3B:
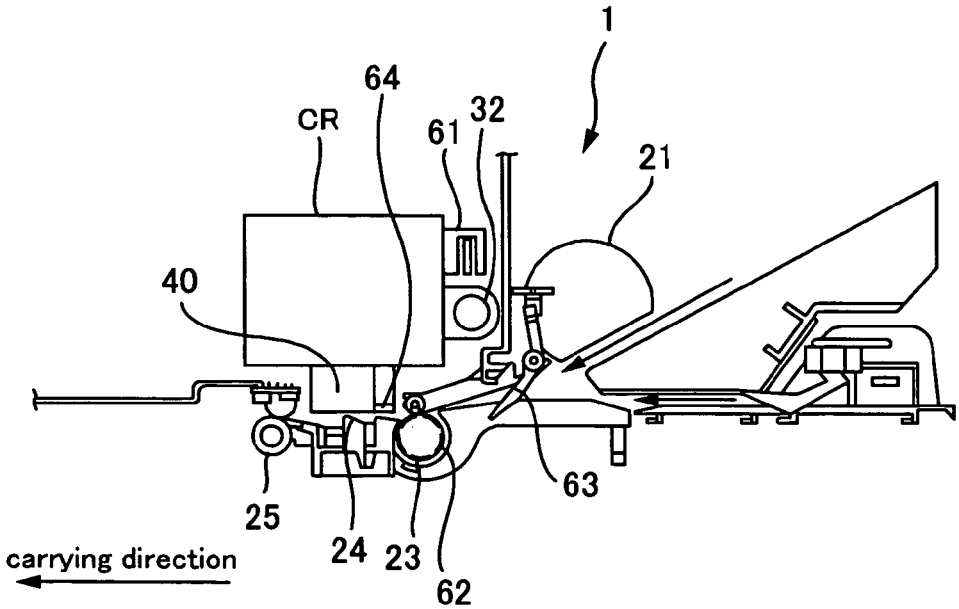
FIG. 3B is a side view showing the structure of the printer.

This section below describes the configuration of the printer 1. Here, FIG. 3A is a schematic diagram showing the structure of the printer 1 in the present embodiment. FIG. 3B is a side view showing the structure of the printer 1 in the present embodiment. In the explanation below, FIG. 2 is also referred to. This printer 1 has a paper carrying mechanism 20, a carriage moving mechanism 30, a head unit HU (a head 40 and a head controller 50), a power source control circuit PWS, a detector group 60, and a printer-side controller 70, as shown in FIG. 2. The power source control circuit PWS and the printer-side controller 70 are provided on a common controller board CTR. The controller board CTR and the head unit HU are mutually connected through a flexible flat cable FC.

In the printer 1, the printer-side controller 70 controls control targets such as the paper carrying mechanism 20, the carriage moving mechanism 30, the head 40, and the head controller 50. The printer-side controller 70 controls the control targets based on print data received from the computer 110, and makes the control targets perform printing of an image on the paper S. At that time, each detector of the detector group 60 detects conditions of each section in the printer 1 and outputs a result of the detection to the printer-side controller 70. The printer-side controller 70 receives the result of the detection from each of detectors and controls the control targets based on the result of the detection.

Regarding Paper Carrying Mechanism 20

The paper carrying mechanism 20 serves as a medium carry section for carrying a medium. The paper carrying mechanism 20 sends the paper S as a medium up to a printable position and carries the paper S by a predetermined carry amount in a carrying direction. As shown in FIGS. 3A and 3B, the paper carrying mechanism 20 has a paper supply roller 21, a carry motor 22, a carry roller 23, a platen 24, and a paper discharge roller 25. The paper supply roller 21 is a roller for supplying, into the printer 1 automatically, the paper S that has been inserted to a paper insert opening, and has a D-shaped cross-section in this example. The carry motor 22 is a motor for carrying the paper S in the carrying direction, and its operation is controlled by the printer-side controller 70. The carry roller 23 is a roller for carrying the paper S which has been supplied by the paper supply roller 21 up to a printable region. The platen 24 is a member for supporting the paper S from below. The paper discharge roller 25 is a roller for carrying the paper S for which printing has ended.

Regarding Carriage Moving Mechanism 30

The carriage moving mechanism 30 is for moving a carriage CR in the carriage movement direction; the carriage CR has the head unit 40 attached thereto. This carriage moving mechanism 30 has a carriage motor 31, a guide shaft 32, a timing belt 33, a drive pulley 34, and an idler pulley 35. The carriage motor 31 serves as a driving power source for moving the carriage CR. Operation of the carriage motor 31 is controlled by the printer-side controller 70. The drive pulley 34 is attached to a rotating shaft of the carriage motor 31. The drive pulley 34 is arranged at the one end side of the carriage movement direction. The idler pulley 35 is arranged at the other end side of the carriage movement direction, which is located opposite the drive pulley 34. The timing belt 33 is connected to the carriage CR, and is mounted on and extended between the drive pulley 34 and the idler pulley 35. The guide shaft 32 supports the carriage CR movably. The guide shaft 32 is attached along the carriage movement direction. Accordingly, on operation of the carriage motor 31, the carriage CR moves along the guide shaft 32 in the carriage movement direction.

Regarding Head Unit HU

Figure 4A:
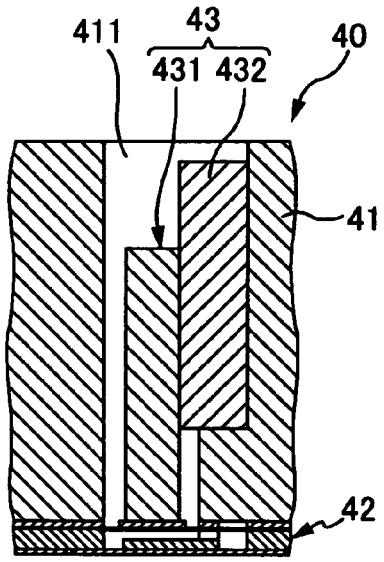
FIG. 4A is a cross-sectional view showing the structure of a head.
Figure 4B:
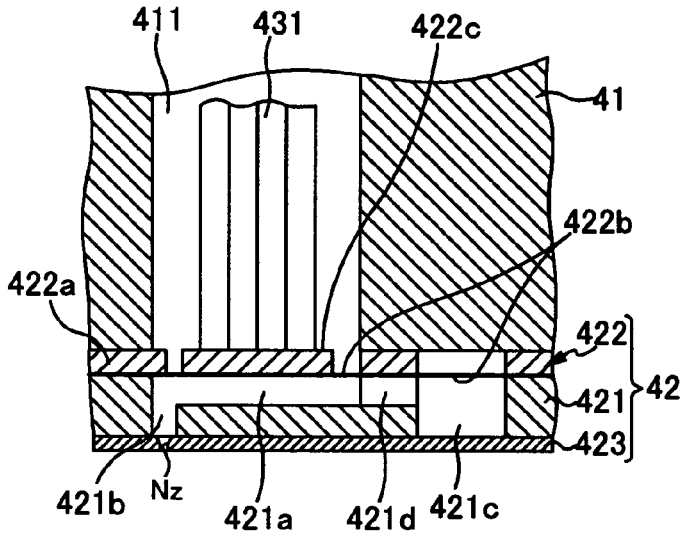
FIG. 4B is a magnified cross-sectional view showing a part of the head.
Figure 4C:
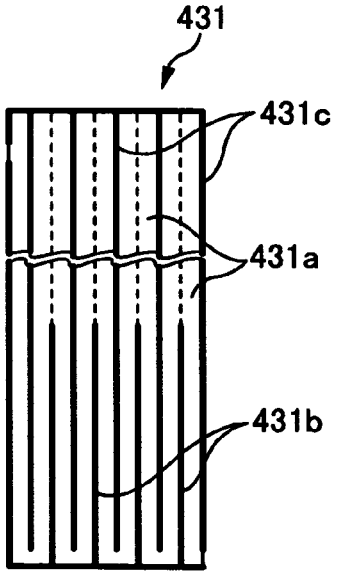
FIG. 4C is a schematic illustration showing the structure of a piezo element provided on the head.
Figure 4D:
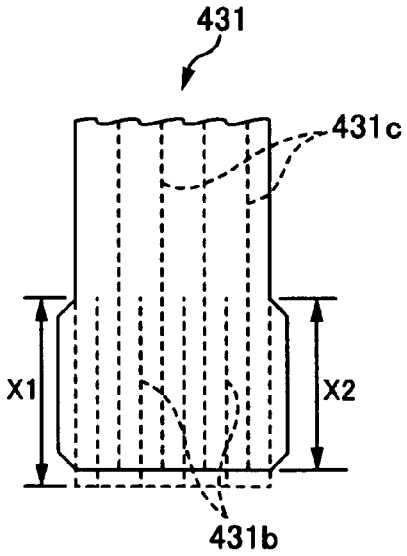
FIG. 4D is a schematic diagram showing deformation of the piezo element provided on the head.
Figure 5:
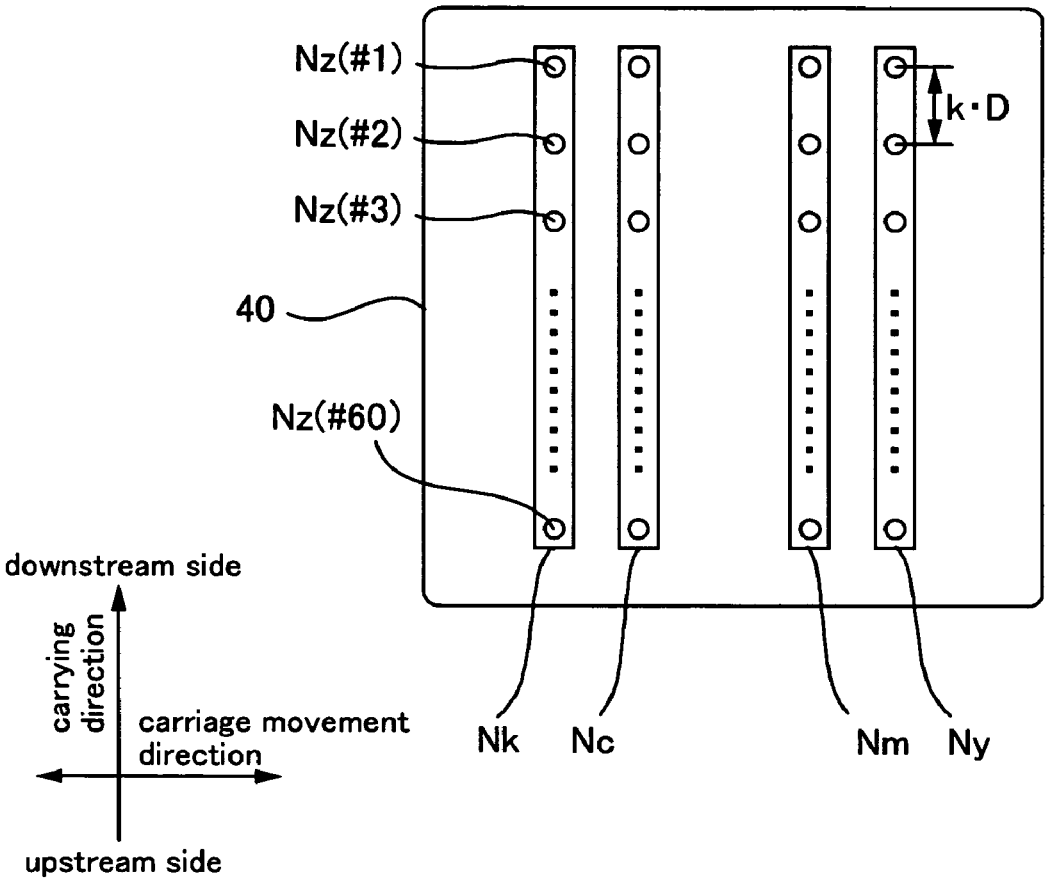
FIG. 5 is an explanatory diagram showing the arrangement of nozzle rows provided on a head.

The head unit HU is for ejecting ink, which is a type of liquid, to the paper S, which is a type of a medium. The head unit HU has the head 40 and the head controller 50. Here, FIG. 4A is a cross-sectional view showing the structure of the head 40. FIG. 4B is a magnified cross-sectional view showing a part of the head 40. FIG. 4C is a schematic illustration showing the structure of the piezo element 431 provided on the head 40. FIG. 4D is a schematic diagram showing deformation of the piezo element 431 provided on the head 40. FIG. 5 is an explanatory diagram showing the arrangement of nozzle rows provided on the head 40. For convenience of explanation, the section below describes the head 40, and the head controller 50 is described in detail later.

Regarding Head 40

The head 40 has a case 41, a flow path unit 42, and piezo element units 43. The case 41 is a block-like member having containment chambers 411 for containing the piezo element units 43. The flow path unit 42 has a flow-path-forming plate 421, an elastic plate 422 which is joined to one surface of the flow-path-forming plate 421, and a nozzle plate 423 which is joined to the other surface of the flow-path-forming plate 421. The flow-path-forming plate 421 has groove portions which serve as pressure chambers 421*a*, through openings which serve as nozzle link openings 421*b*, through openings which serve as shared ink chambers 421*c* (that is, "shared liquid chambers"), and groove portions which serve as ink supply paths 421*d* (that is, "liquid supply paths"), formed therein. The elastic plate 422 has a support frame 422*a*, an elastic film 422*b*, and island sections 422*c*. The elastic film 422*b* covers openings of the groove portions which serve as the pressure chambers 421*a*. The island sections 422*c* are provided on a surface of the elastic plate 422, the surface being located opposite the pressure chambers 421*a*. As a result thereof, in the periphery of each island section 422*c*, an elastic region is formed by the elastic film 422*b*. The island sections 422*c* and a portion of the elastic film 422*b* which covers the openings of the groove portions serve as an elastic section which partitions each of the pressure chambers 421*a*. The piezo element 431 deforms the elastic film 422*b*. The nozzle plate 423 is furnished with a plurality of nozzles Nz.

The piezo element units 43 consist of a plurality of the piezo elements 431 and an adhesive substrate 432. The piezo element 431 is a type of electrically-chargeable element which can store electric charge and is deformed depending on a quantity of stored electric charge. The illustrated piezo element 431 is formed by cutting in a comb-teeth shape a piezo substrate which is made by laminating electrode layers and piezoelectric material layers alternately and firing them. An upper half section of each piezo element 431 adheres to the adhesive substrate 432. Thus, each of the piezo elements 431 is fixed to the adhesive substrate 432, in a so-called cantilever structure. The piezo elements 431 is fixed in parallel with one another, and a surface of a tip of a lower half section of each piezo element 431 is joined to the island section 422*c*.

As shown in FIG. 4C, each of the piezo elements 431 has a laminar structure in which an individual electrode 431*b* (that is, one electrode) and a common electrode 431*c* (that is, the other electrode) are alternately laminated so as to sandwich each of the piezoelectric material layers 431*a*, that is, a dielectric. In short, each of a plurality of piezo elements 431 has the individual electrode 431*b* and the common electrode 431*c*.

Here, the individual electrode 431*b* is an electrode, the electric potential of the electrode being controlled for each of the piezo elements 431. On the other hand, the common electrode 431*c* is an electrode, the electric potential of the electrode being common to all of the piezo elements 431. In the present embodiment, the common electrode 431*c* is set at ground potential. The individual electrode 431*b* and the common electrode 431*c* are provided on each of the piezo elements 431. Here, an extending and contracting section (that is, a deforming section) is a section in which the individual electrode 431*b* and the common electrode 431*c* overlap when viewed from a direction in which layers are laminated. The extending and contracting section is located outside edges of the adhesive substrate 432, and extends or contracts (that is, is deformed) depending on the electric potential difference between the individual electrode 431*b* and the common electrode 431*c*. For example, if the electric potential of the individual electrode 431*b* is higher than that of the common electrode 431*c*, the extending and contracting section contracts in a direction perpendicular to the direction in which layers are laminated and the length thereof changes to X2 from X1 corresponding to the normal state as shown in FIG. 4D. Since the piezo element 431 obtains mechanical energy from electrical energy, the piezo element 431 is suitable for working as an actuator to eject ink. In addition, since there is strong correlation between the electric potential and an amount of extension and contraction, highly precise control of the piezo element 431 can be achieved.

The adhesive substrate 432 is a rectangular board; an upper half section (a root section) of each of a plurality of the piezo elements 431 adheres to one surface of the adhesive substrate 432, and the case 41 adheres to the other surface of the adhesive substrate 432. Since the case 41 adheres to the adhesive substrate 432, the piezo element 431 displaces the island section 422*c* by its deformation. Describing briefly, if the piezo element 431 extends by its deformation, the island section 422*c* is pushed to the side of the pressure chamber 421*a*, or if the piezo element 431 contracts by its deformation, the island section 422*c* is pulled to the opposite side. Such displacement of the island section 422*c* enables to deform the elastic film 422*b* and to generate fluctuation in the pressure of ink in the pressure chamber 421*a*. This enables to eject ink from the nozzle Nz which is in communication with the pressure chamber 421*a*.

As shown in FIG. 5, the head 40 is furnished with a plurality of the nozzles Nz. A nozzle row consists of a predetermined number of nozzles Nz which are formed at a predetermined spacing. In this example, one nozzle row consists of sixty nozzles Nz which are formed at a predetermined spacing k·D. In the head 40, four nozzle rows are lined up parallel to one another in a carriage movement direction. Each of the nozzle rows are a black ink nozzle row Nk, a cyan ink nozzle row Nc, a magenta ink nozzle row Nm, and a yellow ink nozzle row Ny. Accordingly, the number of the nozzles Nz provided on the head 40 is 240 in total. The number of the piezo elements 431 provided is also 240, same as the number of the nozzles Nz. Capacitance C0 per one of the piezo elements 431 is 0.1 nF, for example.

Regarding Power Source Control Circuit PWS

The power source control circuit PWS, at the time of ejecting ink, counts the number of nozzles Nz to eject ink (in other words, piezo elements 431 to be charged and discharged), based on the dot formation data SI. Therefore, the power source control circuit PWS has a counter section 82 (see FIG. 6). The counter section 82 constitutes a controller for charging and discharging the piezo elements 431, together with the printer-side controller 70, shift register circuits 51, and latch circuits 52. The power source control circuit PWS controls a coil switch group 811 provided in a common switch circuit 81 depending on the number of the piezo elements 431 to eject ink (see FIG. 7), and selects and connects one or more targeted coils among a plurality of coils L1 through L8. Also, the power source control circuit PWS equalize the electric potential between the individual electrode 431*b* and the common electrode 431*c* in each of the piezo elements 431, by controlling a selection switch pair 812 provided in the common switch circuit 81 during a period from ending of ink ejection to beginning of next ink ejection. The power source control circuit PWS is described in detail later.

Regarding Detector Group 60

The detector group 60 is for monitoring conditions of the printer 1. As shown in FIGS. 3A and 3B, the detector group 60 includes a linear encoder 61, a rotary encoder 62, a paper detector 63, and a paper width detector 64. The linear encoder 61 is for detecting the position of the carriage CR in the carriage movement direction. The rotary encoder 62 is for detecting an amount of rotation of the carry roller 23. The paper detector 63 is for detecting the paper S to be printed. The paper width detector 64 is for detecting a width of the paper S to be printed.

Regarding Printer-Side Controller 70

The printer-side controller 70 controls each section provided on the printer 1, and constitutes a part of a controller which charges and discharges the piezo elements 431. As shown in FIG. 2, the printer-side controller 70 has an interface section 71, a CPU 72, a memory 73, and a control unit 74. The interface section 71 exchanges data between the computer 110, which is an external device, and the printer-side controller 70. The CPU 72 is a processing unit for carrying out overall control of the printer 1. The memory 73 is for reserving a work area and a storage area for storing the programs for the CPU 72, for instance, and includes storage devices such as a RAM, an EEPROM, a ROM or the like. The CPU 72 operates in accordance with the computer programs stored in the memory 73.

The printer-side controller 70 performs control for printing an image on the paper S. When controlling, the printer-side controller 70 alternately performs an operation in which the paper S is carried by a predetermined carry amount and an operation in which ink is ejected intermittently while the carriage CR (the head 40) is moving. Therefore, the printer-side controller 70 controls carrying of the paper S by controlling the amount of rotation of the carry motor 22. The printer-side controller 70 also controls movement of the carriage CR by controlling rotation of the carriage motor 31. In addition, the printer-side controller 70 controls ejection of ink by outputting to the head controller 50 a head control signal which is for controlling operation of the head 40 (for example, a clock signal CLK, dot formation data SI, a latch signal LAT, a reset signal RST, see FIG. 6).

===Ink Ejection and Control Thereof===

Overview

First, this section gives an overview of control of ink ejection. When controlling of ink ejection, a controller (the counter section 82 of the power source control circuit PWS, see FIG. 6) counts the number of the nozzles Nz to eject ink. In other words, the controller counts the number of the piezo elements 431 (the electrically-chargeable elements) to be charged and discharged. The nozzles Nz and the piezo elements 431 can be identified based on the dot formation data SI. Accordingly, the controller obtains the number of the nozzles Nz and the number of the piezo elements 431 by counting the number of data "1" among the dot formation data SI. Then, the controller determines depending on the number of the nozzles Nz counted a selection manner of coils L1 through L8. More specifically, if the number of the nozzles Nz is "one" or more, the controller determines one or more coils which are to be connected, among the coils L1 through L8 depending on the number of the nozzles Nz. On the other hand, if the number of the nozzles Nz is "zero", none of the coils L1 through L8 is to be connected. The common switch circuit 81 (see FIG. 6) connects one or more targeted coils selectively among the coils L1 through L8 depending on a control signal from the controller. Connection or non-connection for each of the piezo elements 431 is determined by the dot formation data SI; more specifically, whether or not to be charged and discharged is determined. The one or more coils selected among the coils L1 through L8 are connected to the piezo elements 431 and the piezo elements 431 are charged and discharged by resonance.

This configuration enables to determine total inductance L of a plurality of the coils L1 through L8 depending on the number of the piezo elements 431 to be charged and discharged (total capacitance C). This enables to keep constant time width of the drive pulse PS (a resonance cycle T, see FIG. 8B) regardless of the number of the piezo elements 431 to be charged and discharged, and enables to perform control so that a necessary amount of current flows at the time of charge and discharge. As a result thereof, a problem that an unnecessary excessive current flows can be prevented. The section below describes this point in detail.

Regarding Head Controller 50

Figure 7:
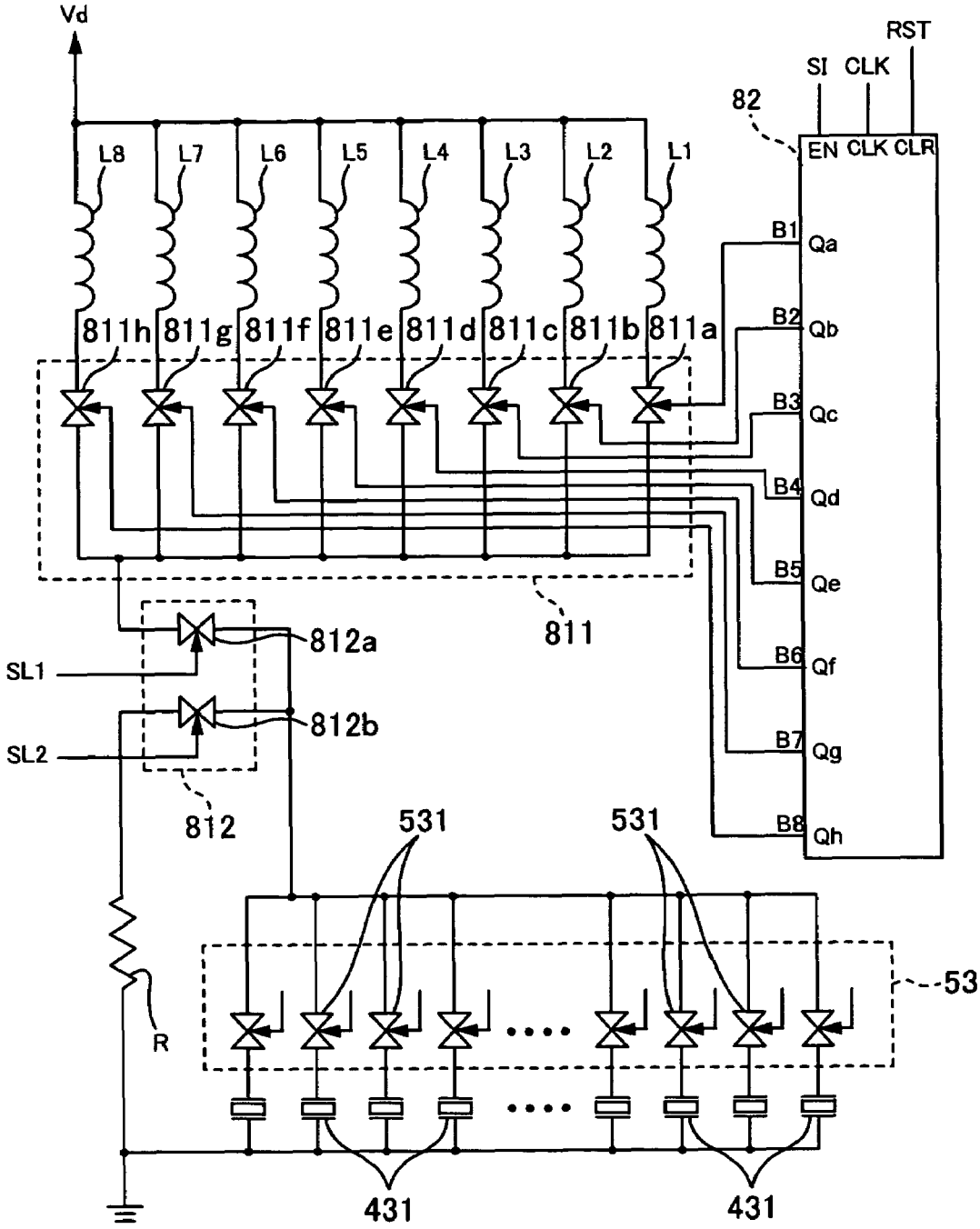
FIG. 7 is a schematic diagram showing a common switch circuit, a counter section and an individual switch circuit.

First, the head controller 50 is described. Here, FIG. 6 is a schematic block diagram showing the power source control circuit PWS and the head controller 50. FIG. 7 is a schematic diagram showing the common switch circuit 81, the counter section 82, and individual switch circuits 53. As shown in FIGS. 6 and 7, the head controller 50 has the shift register circuits 51, the latch circuits 52, and the individual switch circuits 53.

The shift register circuits 51 and the latch circuits 52 are for performing parallel conversion of the dot formation data SI transmitted with serial transmission from the printer-side controller 70, and constitute a part of a controller which is for charge and discharge of the piezo elements 431.

Each of the shift register circuits 51 consists of a plurality of flip-flop circuits (FF circuits, not shown) which are connected in series. The dot formation data SI transmitted with serial transmission from the printer-side controller 70 becomes set to each of the FF circuits in synchronization with clock signal CLK. In the present embodiment, the dot formation data SI corresponding to four colors (240 nozzles) is transmitted with serial transmission over one signal line. Each of the latch circuits 52 latches, at a timing determined by latch signal LAT, the dot formation data SI which is set in each of the shift register circuits 51, and consists of a plurality of the FF circuits (not shown), for example. The number of the FF circuits provided on each of the shift register circuits 51 and the number of the FF circuits provided on each of the latch circuits 52 is the same as the number of the nozzles Nz. The shift register circuits 51 and the latch circuits 52 control the individual switch circuits 53 based on the dot formation data SI.

Each of the individual switch circuits 53 connects the individual electrodes 431*b* of the piezo elements 431 to the other end of the coils L1 through L8 (an end on the side opposite the power supply). More specifically, the individual switch circuits 53 constitute a part of a switch circuit and are for connecting selectively a plurality of the piezo elements 431 (the electrically-chargeable elements). Each of the individual switch circuits 53 has a plurality of individual switches 531 provided on each of the piezo elements 431. In the present embodiment, the individual switch 531 consists of an analog switch which turns ON/OFF based on the dot formation data SI; for example, if the dot formation data SI is data "1", the individual switch 531 is in the ON state, and if the dot formation data SI is data "0", the individual switch 531 is in the OFF state. In this case, a piezo element 431 corresponding to a nozzle Nz having data "1" as the dot formation data SI is to be charged and discharged and then that piezo element 431 extends or contracts. On the other hand, a nozzle Nz (piezo element 431) having data "0" is not to be charged and discharged. In short, that piezo element 431 is not deformed. An individual switch group consisting of a plurality of the individual switches 531 serves as a second switch group. Extension and contraction of the piezo elements 431 and ink ejection is described later.

Regarding Details of Power Source Control Circuit PWS

This section describes the power source control circuit PWS. As shown in FIGS. 6 and 7, the power source control circuit PWS has a plurality of the coils L1 through L8, a resistance R, the common switch circuit 81, the counter section 82, and a power supply 83.

The coils L1 through L8 consists of a reference coil having a largest inductance and the other coils whose inductance are determined to decrease by a ratio of $1/2^n$ with respect to the inductance of the reference coil. In the printer 1, the other seven coils are provided. For convenience of explanation, the reference coil is referred to as a first coil L1 in the explanation below. The other coils are referred to as a second coil L2 through a eighth coil L8 in descending order of inductance.

In the present embodiment, inductance of the first coil L1 (the reference coil) is set to L0 (16.2 mH). Inductance of the second coil L2 is set to 1/2 L0 ($1/2^1$L0=8.1 mH). In the same way, each inductance of the other remaining coils is determined to decrease by a ratio of $1/2^n$. More specifically, the third coil L3 is set to 1/4 L0 ($1/2^2$L0), the fourth coil L4 is set to 1/8 L0 ($1/2^3$L0), the fifth coil L5 is set to 1/16 L0 ($1/2^4$L0), the sixth coil L6 is set to 1/32 L0 ($1/2^5$L0), the seventh coil L7 is set to 1/64 L0 ($1/2^6$L0), and the eighth coil L8 is set to 1/128 L0 ($1/2^7$L0).

Each of the coils L1 through L8 is connected to one another in parallel. One end of each of coils L1 through L8 is connected to the power supply 83 provided in the power source control circuit PWS. The power supply 83 is for applying a uniform drive potential Vd to one end of the coils. In the present embodiment, the power supply 83 applies 15V drive potential Vd, for example.

The common switch circuit 81 constitutes a part of the switch circuit, and is used when connecting a plurality of the coils L1 through L8 selectively or equalizing the electric potential between a pair of the electrodes provided in each of the piezo elements 431. Therefore, the common switch circuit 81 has the coil switch group 811 which is for selectively connecting a plurality of the coils L1 through L8, and the selection switch pair 812 which is for connecting the individual electrodes 431*b* provided on the piezo elements 431 to the coil side (the side of the coil switch group 811) or to the ground side (the side of the resistance R).

The coil switch group 811 serves as a first switch group and has a plurality of coil switches 811*a* through 811*h* which are provided respectively corresponding to each of a plurality of the coils L1 through L8. In this example, the first coil switch

811*a* is provided corresponding to the first coil L1, and the second coil switch 811*b* is provided corresponding to the second coil L2. The coil switches are also provided corresponding to each of the other remaining coils. Accordingly, the coil switch group 811 consists of eight coil switches: the first coil switch 811*a* through the eighth coil switch 811*h* corresponding to the eighth coil L8. Each of the coil switches 811*a* through 811*h* operates according to output from the counter section 82 as mentioned below.

The selection switch pair 812 is for connecting the one or more coils selected among the coils L1 through L8 by the coil switch group 811, to the individual electrodes 431*b* provided on the piezo elements 431, and is for connecting the individual electrodes 431*b* to ground through a resistance R. The selection switch pair 812 has a first selection switch 812*a* which is arranged between the coil switch group 811 and the individual electrodes 431*b*, and a second selection switch 812*b* which is arranged between individual switches 531 and the resistance R. The first selection switch 812*a* and the second selection switch 812*b* consist of an analog switch respectively. The first selection switch 812*a* operates depending on a first selection signal SL1 from the printer-side controller 70, and the second selection switch 812*b* operates depending on a second selection signal SL2 from the printer-side controller 70. If the printer-side controller 70 connects the one or more coils selected among the coils L1 through L8 to selected piezo elements 431, the printer-side controller 70 changes the first selection switch 812*a* to the connected state by the first selection signal SL1. On the other hand, if the printer-side controller 70 connects the common electrode 431*c* to ground, the printer-side controller 70 changes the second selection switch 812*b* to the connected state by the second selection signal SL2.

In the present embodiment, the common electrodes 431*c* provided on the piezo elements 431 are at ground potential. Accordingly, when the second selection switch 812*b* is changed to the connected state, electric potential of the individual electrode 431*b* and electric potential of the common electrode 431*c* are equalized and become at ground potential. The selection switch pair 812 constitutes a part of the switch circuit, and serves as another switch circuit for equalizing the electric potential between the common electrode 431*c* and the individual electrode 431*b* provided on each of the piezo elements 431.

The counter section 82 constitutes a part of the controller and consists of a binary counter in the present embodiment. The counter section 82 counts the number of data "1" which corresponds to formation of a dot, among the dot formation data SI. As mentioned above, in the present embodiment, the dot formation data SI for all nozzles Nz corresponding to four colors is transmitted over one signal line. Therefore, a counted value of the binary counter indicates the number of the nozzles Nz to eject ink among the 240 nozzles Nz. Accordingly, the counter has a configuration in which the value "240" can be counted. The counter section 82 in the present embodiment consists of an 8-bit binary counter. Output of the binary counter is used as a control signal of the coil switch group 811. For example, output Qa corresponding to a lowest bit is used as a control signal of the first coil switch 811*a*. Also, output Qb corresponding to a second lowest bit is used as a control signal of the second coil switch 811*b*. Each of the other outputs also corresponds to each of the other bits, and output Qh corresponding to a highest bit is used as a control signal of the eighth coil switch 811*h*.

A relationship between the counted value of the counter section 82 (the binary counter) and total inductance L of the one or more coils selected among the coils L1 through L8, and a relationship between the counted value and total capacitance C of the piezo elements 431 to be charged and discharged at the time of ejecting ink is described later.

Regarding Overview of Operation in Ink Ejection

Figure 8A:
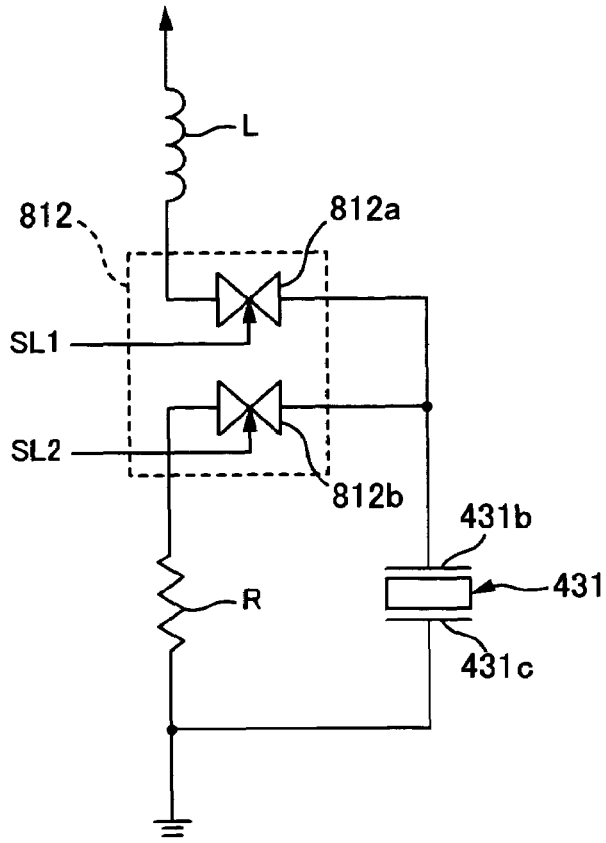
FIG. 8A is a simplified diagram showing an electric circuit consisting of coils and piezo elements.
Figure 8B:
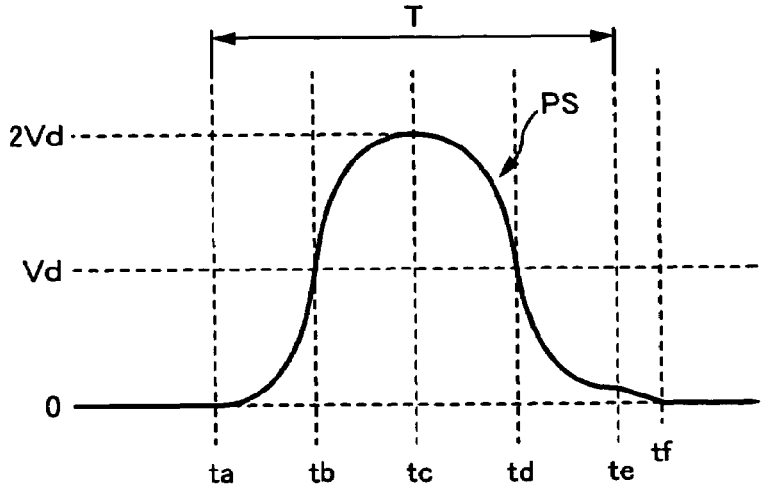
FIG. 8B is a graph showing the electric potential difference in ink ejection between an individual electrode and a common electrode.
Figure 9A:
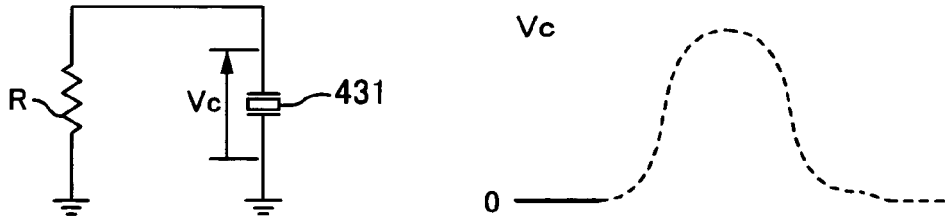
FIG. 9A is a diagram and a graph showing the state before ink ejection.
Figure 9B:
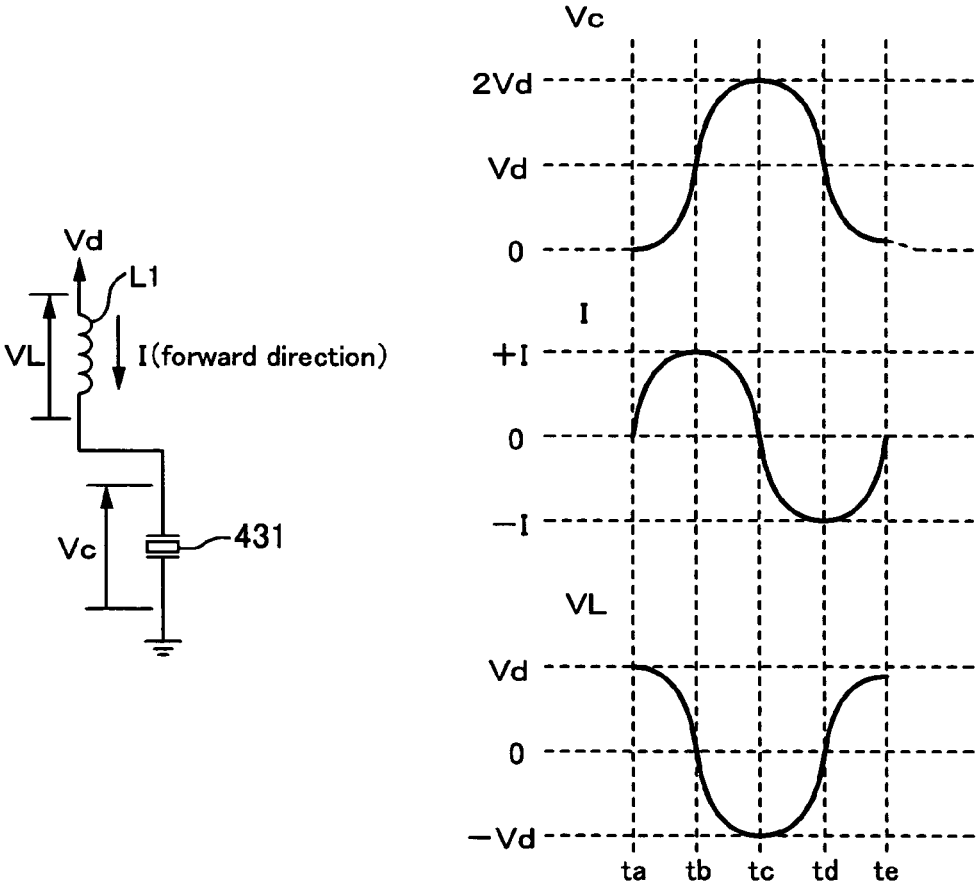
FIG. 9B is a diagram and a graph showing the state during ink ejection.
Figure 9C:
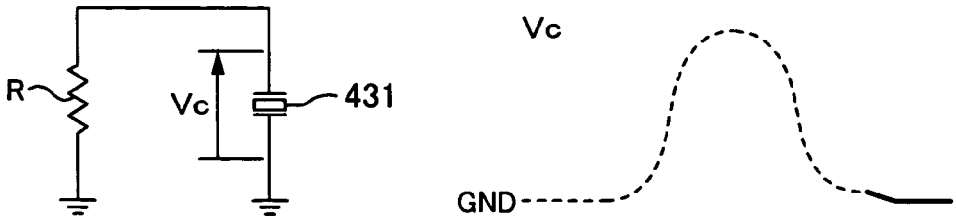
FIG. 9C is a diagram and a graph showing the state after ink ejection.

This section describes an overview of operation in ink ejection. Here, FIG. 8A is a simplified diagram showing an electric circuit consisting of coils L (L1 through L8) and piezo elements 431. In this diagram, the coil L shows the selected coils as a whole, and the piezo element 431 shows collectively piezo elements to be charged and discharged. FIG. 8B is a graph showing the electric potential difference at the time of ink ejection between the individual electrode 431*b* and the common electrode 431*c*. FIG. 9A is a diagram and a graph showing the state before ink ejection. FIG. 9B is a diagram and a graph showing the state during ink ejection. FIG. 9C is a diagram and a graph showing the state after ink ejection.

If ink is ejected from nozzles Nz, data "1" is set on those nozzles Nz as the dot formation data SI. Depending on the number of the data "1", one or more corresponding coil switches among the coil switches 811*a* through 811*h* changes to the connected state. More specifically, the circuit shown in FIG. 8A is constituted in this state. In this circuit, when the first selection switch 812*a* changes to the On state, resonance occurs between the coils L and those piezo elements 431. As shown in FIG. 8B, those piezo elements 431 are charged and discharged by this resonance and the electric potential difference occurs between the individual electrode 431*b* and the common electrode 431*c* provided on each of those piezo elements 431. Those piezo elements 431 extend and contract by this the electric potential difference. Then, ink is ejected from those nozzles Nz.

More specifically, before those piezo elements 431 extend and contract, the printer-side controller 70 sets the first selection signal SL1 at the OFF level (L-level) and the second selection signal SL2 at the ON level (H-level). As a result thereof, the second selection switch 812*b* changes to the On state and, as shown in FIG. 9A, the individual electrode 431*b* provided on each of the piezo elements 431 becomes connected to a ground through the resistance R. As a result thereof, the electric potential is equalized between the individual electrode 431*b* and the common electrode 431*c* and becomes at ground potential. In other words, the electric potential difference between the individual electrode 431*b* and the common electrode 431*c* becomes at 0 V (hereinafter referred to as the electric potential difference Vc; note that the common electrode 431*c* is used as a reference for the electric potential difference Vc). In this state, no voltage is applied to the piezoelectric material layer 431*a* and the piezo elements 431 become the normal state (in short, in the state in which the piezo elements 431 does not extend and contract).

Thereafter, the printer-side controller 70 sets the first selection signal SL1 at the ON level and the second selection signal SL2 at the OFF level. As a result thereof, the first selection switch 812*a* changes to the On state, and the individual electrode 431*b* provided on each of those piezo elements 431 is connected to the power supply 83 through the coils L as shown in FIG. 9B. Each of those piezo elements 431 forms a resonant circuit together with the coils L because those piezo elements 431 are considered to be capacitors in an electric circuit. Therefore, a current flows through the coils L, and the electric potential difference Vc between the individual electrode 431*b* and the common electrode 431*c* changes with time.

Here, change of the electric potential difference Vc is described based on the graph of FIG. 9B. An upper part in the graph of FIG. 9B shows the electric potential difference Vc between the individual electrode 431*b* and the common electrode 431*c*. A middle part is a graph showing a current I flowing to the coils L. In this graph, a direction from the side of the power supply 83 to those piezo elements 431 is shown as a forward direction for a flowing current. A lower part shows the electric potential difference VL between both ends of the coils L. Note that an end connecting to each of those piezo elements 431 is used as a reference for the electric potential difference VL.

At the moment when the first selection switch 812*a* changes to the On state (timing ta), the electric potential difference Vc between the individual electrode 431*b* and the common electrode 431*c* is zero. The electric potential difference VL between both ends of the coils is equal to the difference between drive potential Vd and ground potential. Thereafter, when the current I flows to the side of the individual electrode 431*b* through the coils L, the electric potential of the individual electrode 431*b* increases. In other words, the electric potential difference Vc between the individual electrode 431*b* and the common electrode 431*c* increases. If the current I flows to the side of the individual electrode 431*b*, magnetic flux is generated within the coils L. This magnetic flux interferes with the current flowing to the side of the individual electrode 431*b* and is stored in the coils L as energy. At the time when the electric potential of the individual electrode 431*b* becomes equal to drive potential Vd (timing tb), energy of magnetic flux stored in the coils L starts to flow as current I. Here, the current I flowing in the coils L continues to flow to the same direction because the current I has a tendency to flow continuously. As a result thereof, the polarity of the electric potential difference VL in the coils L is reversed on and after timing tb. The electric potential of the individual electrode 431*b* becomes higher than drive potential Vd.

At the time when energy stored in the coils L runs out (timing tc), the electric potential of the individual electrode 431*b* becomes approximately twice drive potential Vd. At timing tc, the electric potential of the individual electrode 431*b* becomes higher than the electric potential of the common electrode 431*c*, and those piezo elements 431 contract most since the electric potential difference Vc is greatest. Thereafter, in order to cancel the electric potential difference VL of the coils L, the current I starts to flow in a backward direction, which is from the coils L to the power supply 83. The current I flowing in the backward direction makes the electric potential of the individual electrode 431*b* lower with time. Also, the current I in the backward direction stores energy attributed to magnetic flux in the coils L. At the time when the electric potential of the individual electrode 431*b* becomes equal to drive potential Vd (timing td), energy of magnetic flux starts to flow as a current. Therefore, current I continues to flow on and after timing td. As a result thereof, the electric potential of the individual electrode 431*b* becomes lower than drive potential Vd. At the time when energy stored in the coils L runs out (timing te), the electric potential of the individual electrode 431*b* becomes at a value slightly higher than ground potential. This is because of a low-resistance component on the circuit such as a switch or because of energy consumption caused by deformation of those piezo elements 431. At this time, those piezo elements 431 extend from the state in which they are at timing tc, and become a state near to the normal state.

Next, the printer-side controller 70 sets the first selection signal SL1 at the OFF level and the second selection signal SL2 at the ON level respectively. As a result thereof, second selection switch 812*b* changes to the On state and the individual electrode 431*b* becomes connected to ground through the resistance R, as shown in the diagram of FIG. 9C. A current flows from the side of the individual electrode 431*b* to the side of ground through the resistance R, and the individual electrode 431*b* is adjusted and becomes at ground potential. In other words, the electric potential of the individual electrode 431*b* becomes equal to the electric potential of the common electrode 431*c*. As a result thereof, those piezo elements 431 return to the above-mentioned initial state. Accordingly, even in the case of repeating extension and contraction of those piezo elements 431, the piezo elements 431 can extend and contract in the same way. In the present embodiment, this control is performed by the second selection switch 812*b*. This enables adjustment of the electric potential at a desired timing, and makes control easier.

Regarding Ink Ejection

Figure 10:
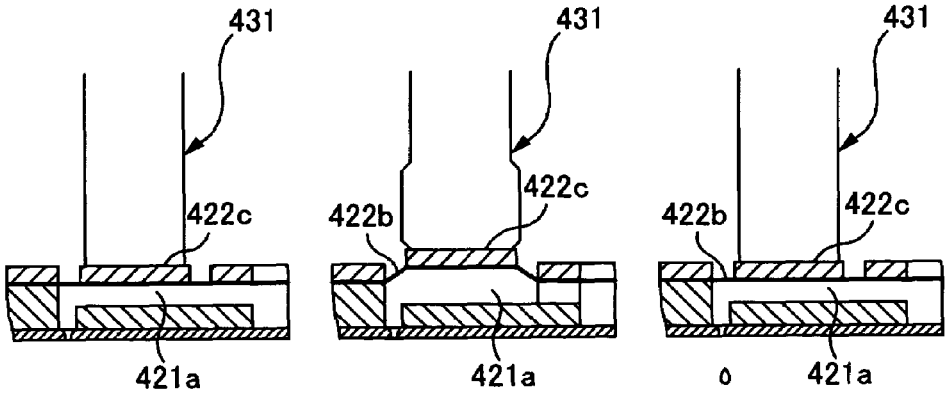
FIG. 10 is a group of explanatory diagrams showing a piezo element extending and contracting.

When the electric potential difference Vc is applied between the individual electrode 431*b* and the common electrode 431*c* of those piezo elements 431, ink is ejected from the nozzle Nz by extending and contracting of those piezo elements 431. Here, FIG. 10 is a group of explanatory diagrams showing those piezo elements 431 extending and contracting when the dot formation data SI is data "1". In FIG. 10, the left diagram is an explanatory diagram showing those piezo elements 431 in the normal state (the state in which the electric potential difference Vc is zero) before extension and contraction. The middle diagram is an explanatory diagram showing those piezo elements 431 when the electric potential difference Vc is greatest. The right diagram is an explanatory diagram showing those piezo elements 431 when it returns to the normal state after extension and contraction.

The second selection switch 812*b* is in the connected state before extending and contracting. In this case, the electric potential difference Vc is zero as mentioned above. Accordingly, all of the piezo elements 431 become the normal state (the left diagram). Each of the island sections 422*c* becomes set at its initial position corresponding to the normal state. Then, the first selection switch 812*a* changes to the connected state. As a result thereof, the individual electrode 431*b* of each of those piezo elements 431 is connected to the power supply 83 through the coils L. As a result thereof, current I flows through the coils L and those piezo elements 431 (extending and contracting sections) contract in a direction perpendicular to a direction in which electrode layers are laminated (the middle diagram). With this contraction, island sections 422*c* of those piezo elements 431 are pulled to a direction opposite to the pressure chambers 421*a*. As a result thereof, the pressure chambers 421*a* expand by deformation of the elastic film 422*b*, and ink stored in a shared ink chamber 421*c* flows into the pressure chambers 421*a* through the ink supply path 421*d*. Thereafter, those piezo elements 431 extend in a direction perpendicular to the direction in which electrode layers are laminated as mentioned above. As a result thereof, those island sections 422*c* are pushed to the side of the pressure chambers 421*a*, and return substantially to the initial position. As a result thereof, the pressure chambers 421*a* contract by deformation of the elastic film 422*b* and a portion of ink in the pressure chambers 421*a* is ejected from the nozzles Nz.

And then, the second selection switch 812*b* changes to the connected state. As a result thereof, the individual electrode 431*b* is connected to ground through the resistance R. Thus, the electric potential of the individual electrode 431*b* changes to ground potential, and the electric potential difference Vc between the individual electrode 431*b* and the common electrode 431*c* becomes zero. Accordingly, those island sections 422*c* return to the initial position corresponding to the normal state (the right diagram).

Regarding Drive Pulse PS

As mentioned above, resonance between the coils and each of those piezo elements 431 generates the electric potential difference Vc between the individual electrode 431*b* and the common electrode 431*c* of each of those piezo elements 431. This electric potential difference Vc determines extension and contraction of those piezo elements 431. In other words, those piezo elements 431 extend and contract depending on the electric potential difference Vc. For convenience of explanation, this change of the electric potential difference Vc with respect to time is also referred to as a drive pulse PS. The drive pulse PS shown in FIG. 8B has a waveform equivalent to approximate one cycle of a sine wave. The waveform shows an amount of extension and contraction of those piezo elements 431 with time. More specifically, a left half of the drive pulse PS corresponds to the velocity and an amount of expansion of the pressure chambers 421*a*, and a right half thereof corresponds to the velocity and an amount of contraction of the pressure chambers 421*a*. Accordingly, in order to eject a uniform amount of ink, it is necessary to maintain a uniform waveform of the drive pulse PS.

In the printer 1, the waveform of the drive pulse PS is determined by the resonance cycle T based on the coils and those piezo elements 431. Total capacitance C of those piezo elements 431 is determined depending on the number of the nozzles Nz to eject ink. Accordingly, in order to eject a uniform amount of ink regardless of the number of the nozzles Nz to eject ink, it is necessary, regardless of the number of the nozzles Nz to eject ink, that total inductance L and total capacitance C remain uniform or that a product of total inductance L and total capacitance C remain uniform.

In the printer 1, a certain one or more coils are selected among a plurality of the coils L1 through L8 depending on the number of the nozzles Nz to eject ink. A waveform of drive pulse PS remains uniform thereby. In other words, by changing total inductance L, the product of total inductance L and total capacitance C remains uniform. Changing of total inductance L is performed in order to prevent an unnecessary current from flowing. More specifically, if inductance is steady, and total capacitance is also steady by adding capacitance not relating to ejection, the product of inductance and total capacitance becomes uniform. Accordingly, regardless of the number of the nozzles Nz to eject ink, there is need for current of an amount adequate to charge and discharge all of the piezo elements 431. On the other hand, if total inductance L changes, current of an amount adequate to charge and discharge targeted piezo elements 431 is sufficient. This enables to prevent an unnecessary current from flowing.

Selection of necessary coils is performed according to output from the counter section 82 (the binary counter). The section below describes this point.

Regarding Operation for Selecting Coils

Figure 11:
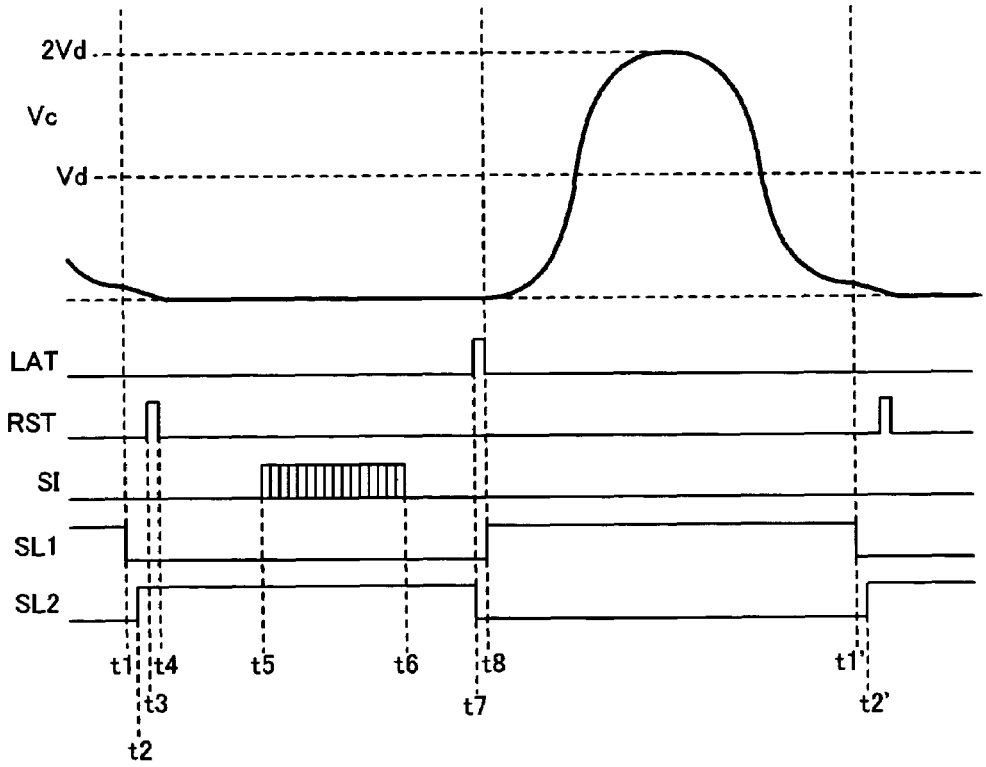
FIG. 11 is a timing chart explaining operation of selecting coils.

FIG. 11 is a timing chart explaining operation of selecting coils. As shown in FIG. 11, counting of the dot formation data SI is performed during a period when the second selection switch 812*b* is in the On state (t2-t7). This is for preventing the coils from connecting to the piezo elements 431 at the time of completion of counting by the counter section. Therefore, the first selection switch 812*a* changes to the OFF state at a timing (t1) before the second selection switch 812*b* changes to the On state, and changes to the On state at a timing (t8) after the second selection switch 812*b* changes to the OFF state.

The counter section 82 is reset before counting the dot formation data SI, by reset signal RST from the printer-side controller 70, for example. More specifically, the counter section 82 is reset by the reset signal RST's being at H-level during a predetermined period (t3-t4). This reset operation ensures that counting is performed precisely.

Thereafter, the dot formation data SI is transmitted from the printer-side controller 70 (t5-t6). As a result thereof, the counter section 82 (the binary counter) counts the number of the dot formation data SI which is set to data "1". More specifically, the counter section 82 identifies the dot formation data SI indicating ink ejection by whether or not it is data "1", and counts the number thereof. In other words, the counter section 82 identifies nozzles Nz to eject ink (piezo elements 431 to be charged and discharged) and counts the number of the nozzles.

If the dot formation data SI, the number of which corresponds to all nozzles Nz, is transmitted, a counted value of the counter section 82 indicates the number of the nozzles Nz to eject ink with a binary number. As mentioned above, the counted values of the counter section 82 (output Qa through Qh) are inputted into the coil switch group 811. Therefore, the coil switches 811*a* through 811*h* corresponding to the counted values of the counter section 82 change to the On state. As a result thereof, one or more coils to be connected are selected among a plurality of coils L1 through L8. Note that the relationship between the counted value of the counter section 82 and coils selected among the coils L1 through L8 is described later.

When the printer-side controller 70 transmits the dot formation data SI, the printer-side controller 70 makes the latch signal LAT change to H-level throughout a predetermined period (t7-t8). Then, the latch circuits 52 latch the dot formation data SI. As a result thereof, the individual switches 531 corresponding to data "1" change to the On state. More specifically, the piezo elements 431 to be charged and discharged become selected. Also, the printer-side controller 70 makes the second selection switch 812*b* change to the OFF state (t7-t2'). Here, a period during which the second selection switch 812*b* is in the OFF state is longer than a period during which the first selection switch 812*a* is in the On state (t8-t1'). More specifically, the second selection switch 812*b* changes to the OFF state before the first selection switch 812*a* changes to the On state, and the second selection switch 812*b* changes to the On state after the first selection switch 812*a* changes to the OFF state. This is for preventing a problem that the first selection switch 812*a* and the second selection switch 812*b* from changing to the On state simultaneously.

The printer-side controller 70 sets the first selection switch 812*a* at the OFF state, and then sets the second selection switch 812*b* at the On state (t8). As a result thereof, the one or more coils selected among the coils L1 through L8 through the coil switch group 811 are connected to the piezo elements 431 selected through the individual switch group, and resonance between these coils L1 through L8 and the piezo elements 431 generates. The above-mentioned drive pulse PS is generated by the resonance, and the piezo elements 431 are charged and discharged. As a result thereof, ink is ejected from nozzles Nz corresponding to the piezo elements 431. At this time, since the coils L1 through L8 are selected depending on the number of nozzles Nz to eject ink, it is possible for the resonance cycle T to remain uniform regardless of the number of the nozzles Nz. The section below describes this point.

Regarding the Number of Nozzles Nz and Resonance Cycle T

FIG. 12 is a table explaining the number of the piezo elements 431 to be charged and discharged and the selected coils. Specifically, FIG. 12 illustrates a relationship among the number of the nozzles Nz to eject ink (N), total capacitance of the piezo elements 431 to be charged and discharged (C), the counted value of the counter section 82 (Ct), the selected coils (L1 through L8), total inductance of the selected coils (L), and the product of total inductance and total capacitance (LC). In the printer 1, the resonance cycle T of drive pulse PS is 8 μs (see FIG. 8B).

Suppose that the counted value of the counter section 82 is 8-bit: "B8, B7, B6, B5, B4, B3, B2, and B1". More specifically, suppose that the number of nozzles Nz to eject ink (N) is expressed in 8-bit binary number: "B8, B7, B6, B5, B4, B3, B2, and B1". In this case, when each of the bits B8 through B1 is "1", the coil switches 811*a* through 811*h* corresponding to each of the bits is in the connected state. On the contrary, when each of the bits B8 through B1 is "0", the coil switches 811*a* through 811*h* corresponding to each of the bits is in the disconnected state. Accordingly, pursuant to the mathematical formula of coils connected in parallel, total inductance L can be expressed as the following formula (1):

$$1/L=B8/L8+B7/L7+\ldots+B2/L2+B1/L1$$

$$L=1/(B8/L8+B7/L7+\ldots+B2/L2+B1/L1) \quad (1)$$

First, this section describes a case in which the number of the piezo elements 431 to be charged and discharged is one (N=1). In this case, capacitance of the piezo elements 431 to be charged and discharged is C0. The counted value of the counter section 82 is "00000001". The first coil L1 is selected because the lowest bit B1 is "1". Inductance of the first coil L1 is L0. Substituting these values into the above formula (1), L=L0 is obtained as shown in the following formula (2).

$$L=1/(0/(1/128L0)+0/(1/64L0)+\ldots+0/(1/2L0)+1/L0) \quad (2)$$

$$=1/(1/L0)$$

$$=L0$$

Accordingly, the product of inductance and capacitance becomes L0×C0. Substituting 16.2 mH into L0 and 0.1 nF into C0 in the following formula (3), the resonance cycle $T=8\times10^{-6}$ "s" is obtained.

$$T=2\pi(L0\times C0)^{1/2} \quad (3)$$

In the case that the number of the piezo elements 431 to be charged and discharged is two (N=2), total capacitance C of the piezo elements 431 is C0+C0 (that is 2C0) because the piezo elements 431 are connected mutually in parallel. The counted value of the counter section 82 is "00000010". Here, the second coil L2 is selected because the lowest bit and the second bit B2 are "1". Inductance of the second coil L2 is 1/2L0. Substituting these values into the above formula (1), L=1/2L0 is obtained. Therefore, the product of the inductance and total capacitance becomes 1/2L0×2C0 (=L0×C0); that is the product is the same as in the case of N=1.

Also, in the case that the number of the piezo elements 431 to be charged and discharged is five (N=5), total capacitance C is 5C0. The counted value of the counter section 82 is "00000101". The first coil L1 and the third coil L3 are selected because the lowest bit B1 and the third bit B3 are "1". Here, inductance of the first coil L1 is L0 and inductance of the third coil L3 is 1/4L0. In this case, substituting these values into the above formula (1), L=1/5L0 is obtained. Accordingly, the product of total inductance and total capacitance becomes 1/5L0×5C0 (=L0×C0); accordingly the product is the same as in the cases of N=1 and N=2.

As shown in FIG. 12, cases in which the number of the nozzles is different from the above case are the same as mentioned above. For example, in the case that the number of the piezo elements 431 to be charged and discharged is 240 (N=240), total capacitance C is 240C0. Total inductance L is 1/240L0 as shown in the following formula (4).

$$L=1/(1/(1/128L0)+1/(1/64L0)+1/(1/32L0)+1(1/16L0)) \quad (4)$$

$$=1/(240/L0)$$

$$=1/240L0$$

Therefore, the product of the inductance and total capacitance becomes 1/240L0×240C0 (=L0×C0); accordingly the product is the same as in the case of N=1.

As can be seen from the above explanation, selecting one or more coils among the coils L1 through L8 through the counted value of the counter section 82 enables the resonance cycle T of the drive pulse PS to remain uniform regardless of the number of nozzles Nz ejecting ink.

CONCLUSION

As explained above, since one or more coils are selected among the coils L1 through L8 depending on the number of the nozzles Nz ejecting ink, that is the number of the piezo elements 431 to be charged and discharged in the first embodiment, the resonance cycle T can remain uniform regardless of the number of the nozzles Nz. An amount of current I flowing when the piezo elements 431 are charged and discharged is determined by the number of the piezo elements 431 to be charged and discharged, that is total capacitance C. Accordingly, this enables to prevent a problem that unnecessary excessive current I flows.

In addition, in the first embodiment, a plurality of the coils L1 through L8 are provided. Total inductance L of a desired value can be obtained even in a case of a small number of coils since the coils are configured by the reference coil having a largest inductance (the first coil L1) and the other coils having inductances that are determined to be a ratio of $1/2^n$ with respect to the inductance of the reference coil (the second coil L2 through the eighth coil L8). In addition, various inductance of a coil can be easily obtained by selecting the number of its turns or the like. Therefore, this is advantageous in terms of manufacturing.

Selection of a plurality of the coils L1 through L8 is performed with a counted value (an output) of the counter section 82 consisting of the binary counter. This enables to omit control of calculation and the like and to simplify processes. In other words, this is suitable for increasing the speed of processes. In addition, the counter section 82 counts data for formation of a dot among the dot formation data SI (data "1"). In other words, the counter section 82 obtains the number of the nozzles Nz to eject ink according to control information for the individual switch 531. This enables to simplify wiring because it is not necessary to run a dedicated wire from the printer-side controller 70.

The Second Embodiment

In the above-mentioned embodiment, an electrically-chargeable element to be charged and discharged is only the piezo elements 431. In this configuration, there is no problem if capacitance of each of the piezo elements 431 is uniform with high accuracy. However, if there is a little variation of capacitance among each of the piezo elements 431, there are cases in which a resonance cycle T can not remain uniform. As mentioned above, in a configuration in which a piece of a piezo substrate which is formed by cutting a piezo substrate in comb-teeth shape (that is, one tooth of comb teeth) corresponds to each of nozzles, there are cases in which thick pieces and thin pieces both are contained depending on precision of cutting position. In this case, capacitance of a thick piece is larger than determined capacitance and capacitance of a thin piece is smaller than determined capacitance. In short, there is variation of capacitance among each of the pieces. Here, since average capacitance for each of the pieces is a desired value, the effect of the variation is negligible if a large number of nozzles eject ink. The effect of the variation is especially conspicuous if ink ejected from a small number of nozzles Nz; for example, cases in which the number of nozzles Nz to eject ink is less than 10 nozzles. This is because, if ink is ejected from a small number of nozzles Nz, the resonance cycle T is affected and varies as a result of variation of capacitance among each of the pieces and further an amount of ink ejected also varies.

The second embodiment has been described in light of the circumstances mentioned above and is aiming to stabilize operation even in a case of a small number of nozzles Nz to eject ink.

Figure 13:
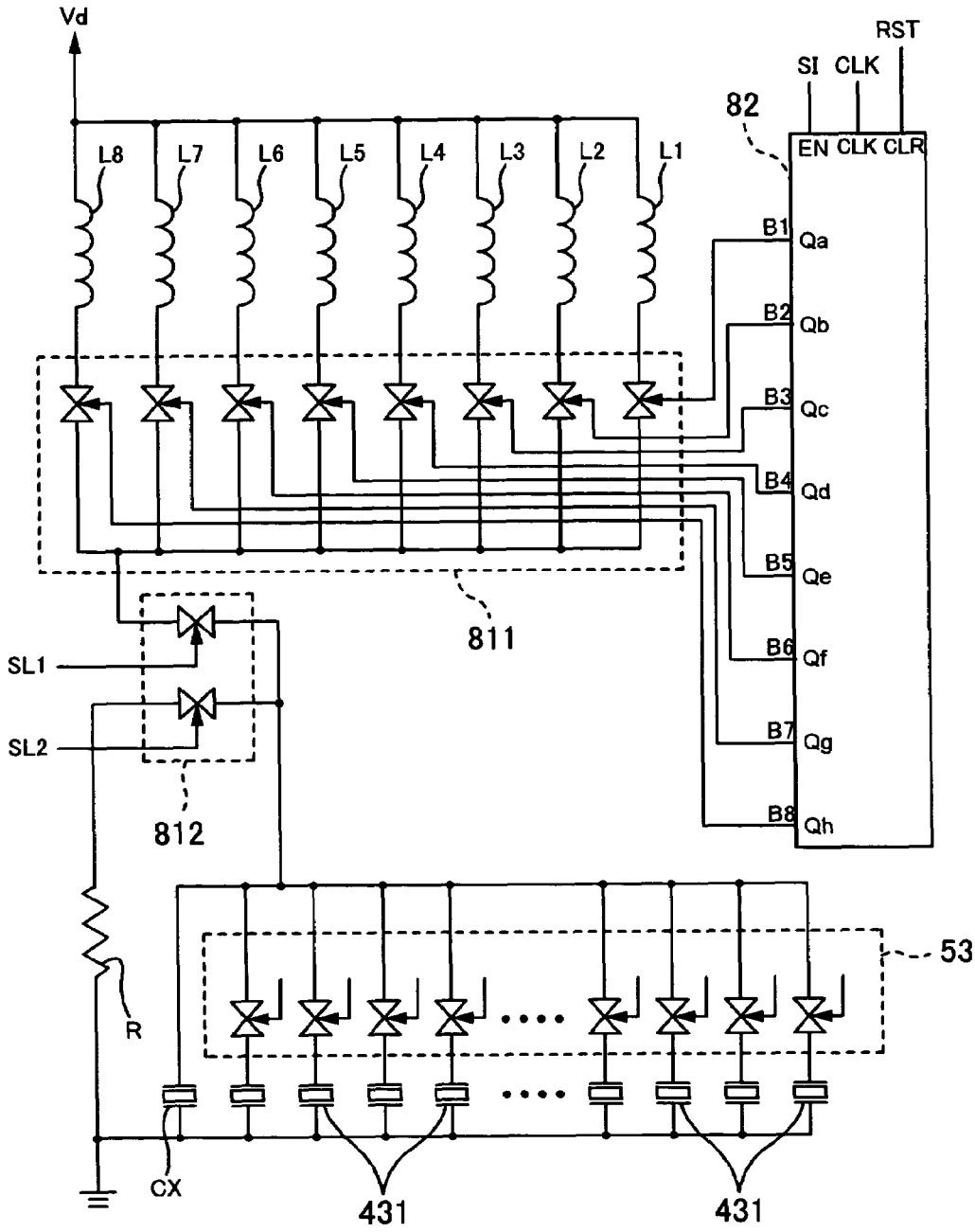
FIG. 13 is a block diagram illustrating the configuration of the second embodiment.
Figure 14:
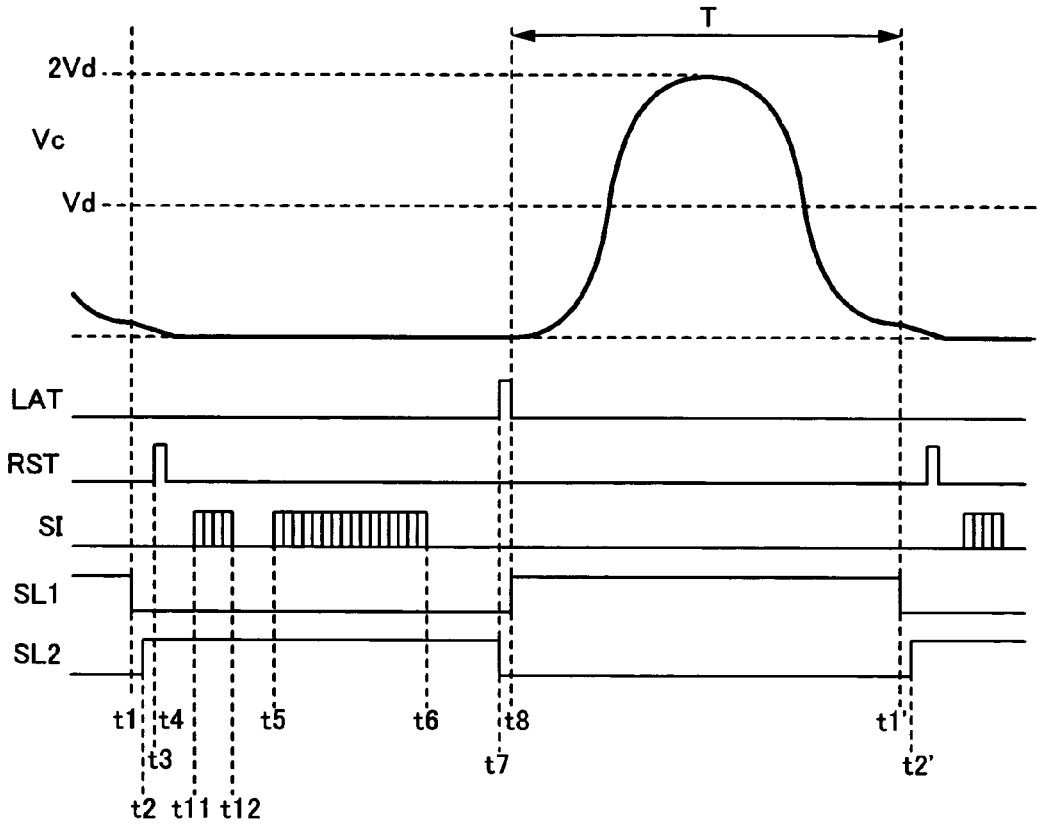
FIG. 14 is a timing chart explaining operation in the second embodiment.

The basic configuration of the second embodiment is the same as the first embodiment. Therefore, the second embodiment is described with focusing on differences from the first embodiment. Here, FIG. 13 is a block diagram illustrating the configuration of the second embodiment. FIG. 13 corresponds to FIG. 7 in the first embodiment. FIG. 14 is a timing chart explaining operation in the second embodiment. FIG. 14 corresponds to FIG. 11 in the first embodiment.

As shown in FIG. 13, a feature of the second embodiment is that an additional capacitor CX, which serves as an other electrically-chargeable element, is provided in parallel to each a plurality of the piezo elements 431. The reason for using a capacitor is because it enables to determine capacitance precisely. Capacitance of the additional capacitor CX is determined to be equivalent to a predetermined number of the piezo elements 431. In the present embodiment, capacitance is determined to be equivalent to ten piezo elements 431. Specifically, since capacitance of one of the piezo elements 431 is 0.1 nF, capacitance of the additional capacitor CX is 1.0 nF.

Since the additional capacitor CX having capacitance equivalent to a predetermined number of the piezo elements 431 is provided as mentioned above, variation of total capacitance C can be reduced even in a case of a small number of nozzles Nz to eject ink. More specifically, variation of total capacitance C can be ignored because capacitance of the additional capacitor CX constitutes a great share of total capacitance. This enables to stabilize the resonance cycle T of a drive pulse PS.

In this case, total capacitance C increases by capacitance of the additional capacitor CX. Therefore, it is necessary to adjust the resonance cycle T. Since the second embodiment has a configuration in which a coil is selected based on a counted value of a counter section 82, it is considered only necessary to increase counted value by a value equivalent to an additional capacitor CX. For example, before transmission of the dot formation data SI, a printer-side controller 70 transmits the dummy dot formation data SI corresponding to additional capacitor CX, as shown in FIG. 14 (t11-t12). In the present embodiment, the dummy dot formation data SI is data for ink ejection (data "1") equivalent to 10 nozzles. As a result thereof, the counted value of the counter section 82 is increased by the dummy dot formation data SI and thereafter is further increased by the dot formation data SI. Accordingly, the counted value can be increased by value equivalent to the additional capacitor CX, and total capacitance including capacitance of the additional capacitor CX can be obtained.

Note that, though the dummy dot formation data SI is set to a shift register circuit 51, the dummy dot formation data SI does not affect operation since the dot formation data SI is set to the shift register circuit 51 thereafter.

Other Embodiments

Though each of the above-mentioned embodiments describes mainly the printing system 100 having the printer 1, it also includes disclosure of liquid ejection device and liquid ejection system, as well as a device or a method for controlling charge and discharge of an electrically-chargeable element. The above-mentioned embodiments are provided for facilitating the understanding of the present invention, and are not to be interpreted as limiting the present invention. As a matter of course, the present invention can be altered and improved without departing from the gist thereof and the present invention includes equivalent thereof, and includes especially embodiments mentioned below.

Regarding Coil

In each of the above-mentioned embodiments, one type of a reference coil is used. However, a plural of types of the reference coil can be provided. In this case, a plural of groups of other coils are also provided. This configuration enables to generate a plural of types of drive pulses PS having different resonance cycles T. As a result thereof, an amount of ink to be ejected can be varied and movements of meniscus (a free surface of ink in the nozzle Nz which is exposed to outside air) can converge quickly after ink ejection.

Regarding Counter Section 82

In each of the above-mentioned embodiments, the counter section 82 consists of a binary counter. However, the invention is not limited to the configuration. Another type of counter is acceptable if the counter can count the number of nozzles Nz to eject ink. Furthermore, printer-side controller 70 can control a coil switch group 811 as well as counts the number of nozzles Nz.

Adding, on the outputting side of the counter section 82 (an 8 bit binary counter, for example), FF circuits the number of which is the same as the number of bits of the counter section 82, output of the FF circuit can be used for ON-OFF control of a common switch circuit 81 (the coil switch group 811). In this case, the FF circuits latches the content of the output of the counter at a timing of a latch signal LAT. Furthermore, in this configuration, the latch signal LAT can be used as a signal for resetting the counter section 82, instead of a reset signal RST. As a result thereof, in FIG. 11, misoperation does not occur even if a transmission process of dot formation data SI corresponding to t5 through t6 is inserted into a period between t8 and t1', which is within the time of charge and discharge. This enables to shorten a period when charge and discharge is not performed from t1 to t8 and to increase frequency of ejection.

Regarding Electrically-Chargeable Element

Though a piezo element 431 is exemplified as an electrically-chargeable element in each of the above-mentioned embodiments, the invention is not limited thereto. Another electrically-chargeable element also can be used in the same way. In addition, though a capacitor is exemplified as another electrically-chargeable element, the invention is not also limited thereto.

Regarding Liquid Ejected from Head 40

Since each of the above-mentioned embodiments is an embodiment relating to the printer 1, liquid dye ink, pigment ink or the like is ejected in the embodiment. However, the invention is not limited to liquid ink. Since it is essential only that what is ejected is liquid, liquid appropriate in a use can be ejected.

Regarding Other Applications

Though a printer 1 is illustrated in the above-mentioned embodiments, the invention is not limited thereto. For example, the same technology as mentioned in the present embodiment can apply to a variety of liquid ejection devices utilizing inkjet technology: color filter manufacturing equipment, dyeing equipment, micromachining equipment, semiconductor manufacturing equipment, surface treatment equipment, three-dimensional molding machine, a vaporizer, organic EL manufacturing equipment (especially, polymer EL manufacturing equipment), display manufacturing equipment, film formation equipment, and DNA chip manufacturing equipment. In addition, methods used therein and manufacturing methods thereof are also included in applications to which the technology as mentioned in the present embodiment can apply.

What is claimed is:

1. An electrically-chargeable element control device, comprising:

(a) a plurality of coils having respective one ends that are connected to a power supply;

(b) a switch circuit that is connected to an other end of each of a plurality of the coils, and that is connected to one electrode provided on each of a plurality of electrically-chargeable elements;

(c) a controller that causes a selected coil to connect to an electrically-chargeable element to be charged and discharged by controlling the switch circuit depending on the number of the electrically-chargeable elements to be charged and discharged, and that causes the electrically-chargeable element to be charged and discharged to charge and discharge with resonance; and (d) an other electrically-chargeable element that is connected in parallel with a plurality of the electrically-chargeable elements and that is charged and discharged regardless of the presence or absence of the electrically-chargeable element to be charged and discharged, wherein the controller comprises a binary counter to count the number of the electrically-chargeable elements to be charged and discharged, wherein the controller increases a counted value of the binary counter by a value equivalent to the other electrically-chargeable element, and wherein the controller controls the switch circuit depending on the counted value of the binary counter.

2. An electrically-chargeable element control device according to claim 1, wherein:

a plurality of the coils include:

a reference coil having a largest inductance; and an other coil having an inductance that is determined to decrease by a ratio of $1/2^n$ (n is a natural number) with respect to the inductance of the reference coil; and the controller determines a selection manner of the reference coil and the other coil depending on the number of the electrically-chargeable elements to be charged and discharged.

3. An electrically-chargeable element control device according to claim 1, wherein:

the switch circuit includes:

a first switch group for connecting selectively a plurality of the coils; and a second switch group for connecting selectively a plurality of the electrically-chargeable elements; and the controller obtains the number of the electrically-chargeable elements to be charged and discharged according to control information for the second switch group, and controls the first switch group.

4. An electrically-chargeable element control device according to claim 3, including:

an other switch circuit for equalizing the electric potential between the one electrode and an other electrode that are provided on the electrically-chargeable element to be charged and discharged.

5. An electrically-chargeable element control device according to claim 1, wherein:

the electrically-chargeable element is configured by a piezo element that is deformed by charging and discharging.

6. An electrically-chargeable element control device according to claim 1, wherein:

the other electrically-chargeable element is configured by a capacitor.

7. An electrically-chargeable element control device, comprising:

a plurality of coils having respective one ends that are connected to a power supply, a plurality of the coils including:

a reference coil having a largest inductance; and an other coil having an inductance that is determined to decrease by a ratio of $1/2^n$ (n is a natural number) with respect to the inductance of the reference coil;

a switch circuit that is connected to an other end of each of a plurality of the coils, and that is connected to one electrode provided on each of a plurality of electrically-chargeable elements configured by a piezo element that is deformed by charging and discharging, the switch circuit including:

a first switch group for connecting selectively a plurality of the coils; and a second switch group for connecting selectively a plurality of the electrically-chargeable elements;

an other switch circuit for equalizing the electric potential between the one electrode and an other electrode that are provided on the electrically-chargeable element;

a controller that:

causes a binary counter to count the number of electrically-chargeable elements to be charged and discharged, according to control information for the second switch group;

controls the first switch group depending on a connected value obtained; and determines a selection manner of the reference coil and the other coil;

causes a selected coil to connect to the electrically-chargeable element to be charged and discharged; and causes the electrically-chargeable element to be charged and discharged to charge and discharge with resonance; and an other electrically-chargeable element that:

is configured by a capacitor, the other electrically-chargeable element being connected in parallel with a plurality of the electrically-chargeable elements, and being charged and discharged regardless of the presence or absence of the electrically-chargeable element to be charged and discharged, wherein the controller comprises the binary counter, wherein the controller increases a counted value of the binary counter by a value equivalent to the other electrically-chargeable element, and wherein the controller controls the switch circuit depending on the counted value of the binary counter.

8. A liquid ejection device, comprising:

(A) a plurality of coils having respective one ends that are connected to a power supply and having respective other ends that are connected to a switch circuit;

(B) a plurality of electrically-chargeable elements having respective one ends that are connected to the switch circuit, and that are deformed depending on stored electric charge;

(C) a plurality of pressure chambers that are respectively provided corresponding to each of a plurality of the electrically-chargeable elements and that generate fluctuation in the pressure of stored liquid by deformation of the electrically-chargeable element;

(D) a plurality of nozzles that are respectively in communication with each of a plurality of the pressure chambers; and (E) a controller that causes a selected coil to connect to an electrically-chargeable element that corresponds to the nozzle that is to eject liquid by controlling the switch circuit depending on the number of the nozzles that are to eject liquid, and that causes the liquid to be ejected from the nozzle that is to eject liquid by causing the electrically-chargeable element corresponding to the nozzle to charge and discharge with resonance;

(F) an other electrically-chargeable element that is connected in parallel with a plurality of the electrically-chargeable elements and that is charged and discharged regardless of the presence or absence of the electrically-chargeable element to be charged and discharged, wherein the controller comprises a binary counter to count the number of the electrically-chargeable elements to be charged and discharged, wherein the controller increases a counted value of the binary counter by a value equivalent to the other electrically-chargeable element, and wherein the controller controls the switch circuit depending on the counted value of the binary counter.

9. A method for controlling an electrically-chargeable element, comprising:

obtaining the number of electrically-chargeable elements to be charged and discharged from among a plurality of electrically-chargeable elements;

selecting a coil to be connected, from among a plurality of coils having respective one ends that are connected to a power supply, depending on the number of the electrically-chargeable elements to be charged and discharged;

connecting the selected coil to the electrically-chargeable element to be charged and discharged, and charging and discharging with resonance the electrically-chargeable element to be charged and discharged, and charging and discharging an other electrically-chargeable element that is connected in parallel with a plurality of the electrically-chargeable elements regardless of the presence or absence of the electrically-chargeable element to charged and discharged; and counting the number of the electrically-chargeable elements to be charged and discharged, wherein a counted value obtained in said counting step is increased by a value equivalent to the other electrically-chargeable element, and wherein said connecting step includes controlling said selecting step depending on the counted value obtained in said counting step.

* * * * *